US005347910A

United States Patent [19]

Avila et al.

[11] Patent Number: 5,347,910

[45] Date of Patent: * Sep. 20, 1994

[54] TARGET ACQUISITION SYSTEM

[75] Inventors: Carl A. Avila, Kent; Kenneth W. Hack, Seattle; John A. Hibbert, Federal Way, all of Wash.

[73] Assignee: The Boeing Company, Seattle, Wash.

[ * ] Notice: The portion of the term of this patent subsequent to Feb. 20, 2009 has been disclaimed.

[21] Appl. No.: 787,212

[22] Filed: Oct. 15, 1985

[51] Int. Cl.[5] ..... F41G 3/22

[52] U.S. Cl. ..... 89/41.22; 89/41.06; 235/411

[58] Field of Search ..... 89/40.03, 37.05, 41.17, 89/41.22, 41.21, 41.06, 36.13; 235/411, 412

[56] References Cited

U.S. PATENT DOCUMENTS

| | | | |
|---|---|---|---|
| 2,364,425 | 12/1944 | Corte | 89/36.13 |
| 2,598,231 | 5/1952 | Davies | 89/36.13 |
| 2,649,840 | 8/1953 | Davidson | 89/36.13 |
| 3,518,369 | 6/1970 | Kuhn | 235/411 |
| 3,946,640 | 3/1976 | Baumann | 89/41.01 |
| 4,004,729 | 1/1977 | Rawicz et al. | 235/411 |
| 4,019,422 | 4/1977 | Magnuson | 89/41.19 |
| 4,097,155 | 6/1978 | Appert | 89/41.06 |
| 4,202,246 | 5/1980 | Schertz et al. | 89/41.06 |
| 4,386,848 | 6/1983 | Clendenin et al. | 244/3.16 |
| 4,583,444 | 4/1986 | Jackson | 89/40.03 |

FOREIGN PATENT DOCUMENTS

| | | | |
|---|---|---|---|
| 2322837 | 11/1974 | Fed. Rep. of Germany | 89/41.22 |
| 301283 | 5/1968 | Sweden | 89/36.13 |
| 675725 | 7/1952 | United Kingdom | 89/41.17 |
| 2143931 | 2/1985 | United Kingdom | 244/3.11 |

*Primary Examiner*—Charles T. Jordan
*Assistant Examiner*—Stephen Johnson
*Attorney, Agent, or Firm*—Kenneth J. Cooper; Bernard A. Donahue; J. Michael Neary

[57] ABSTRACT

A target acquisition system for a mobile air defense system is capable of acquiring and engaging targets in rapid sequence while mounted on a moving vehicle. It incorporates a gyrostabilized turret drive system, an optical sight, a forward looking infrared scanner, an infared guided missile subsystem, an onboard computer, and system controls and displays. The turret drive will maintain a particular elevation and azimuth regardless of the motion of the vehicle on which the turret is mounted so that the target tracking system need not account for movement of the vehicle over the ground. The optical sight projects a set of reticles on a combining glass in front of the gunner, which shows the target on which the missile seeker is locked as well as the target at which the turret is pointed so that gunner can insure that the missile is locked on the correct target. Critical systems status signals are also displayed on the sight reticle by use of symbology so the gunner can monitor the key systems without taking his eyes off the target. The missile system controls eight missiles, two being activated at any one time, and notifies the gunner by an audio tone that the missile is locked onto a target and is ready to fire. The missile firing sequence is automatically controlled by the control electronics and inserts super elevation and lead angle automatically, and selects and activates the next missile to be fired without delay.

8 Claims, 15 Drawing Sheets

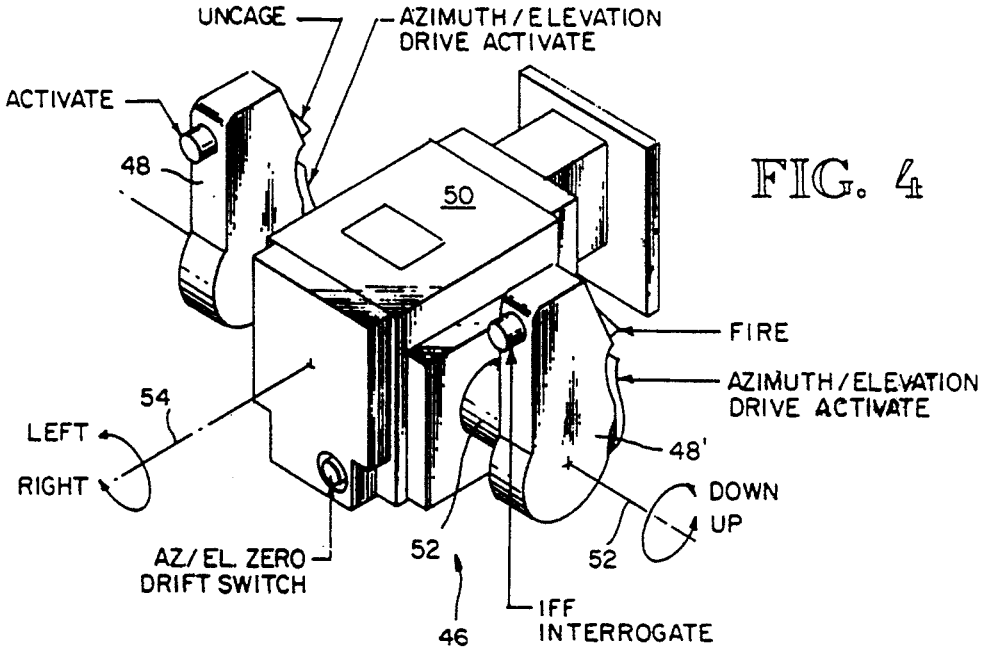
FIG. 4
FIG. 5
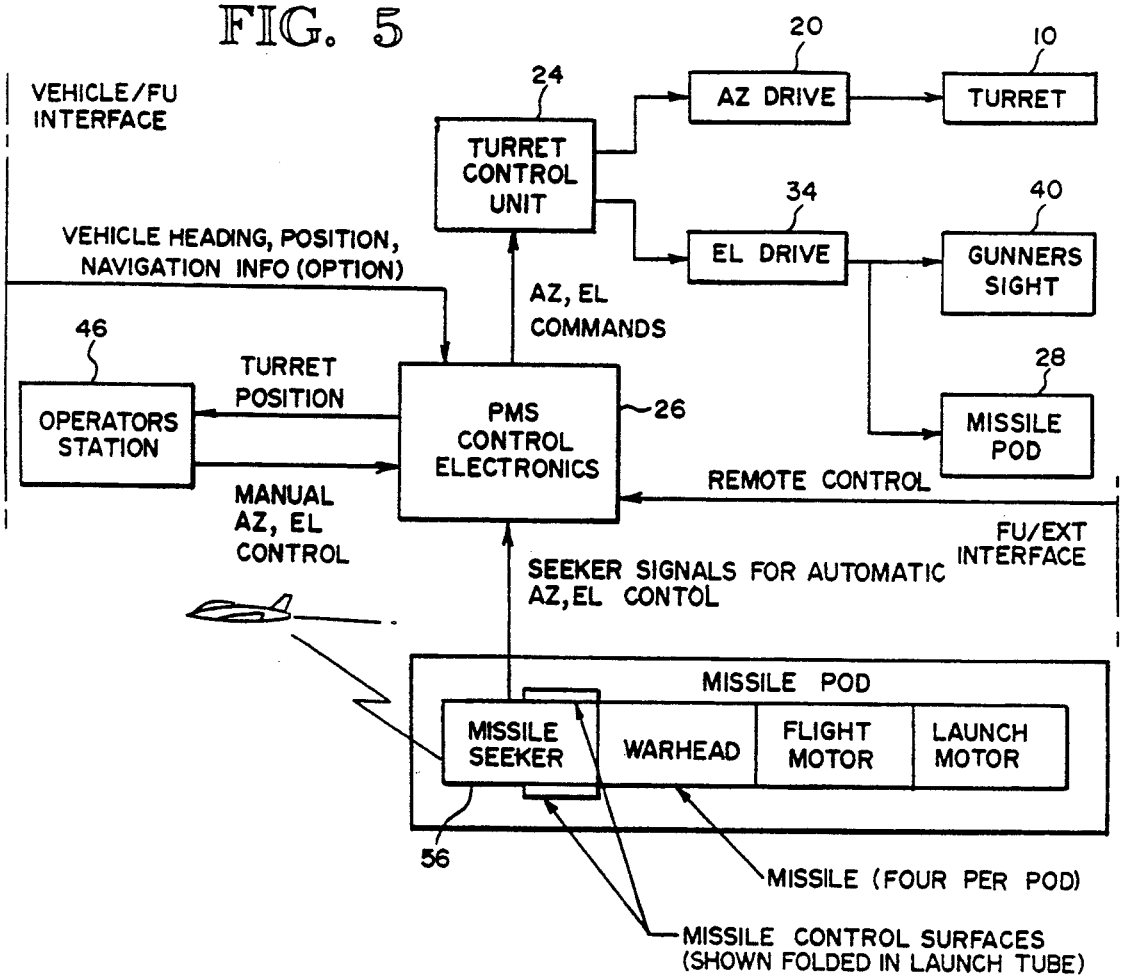

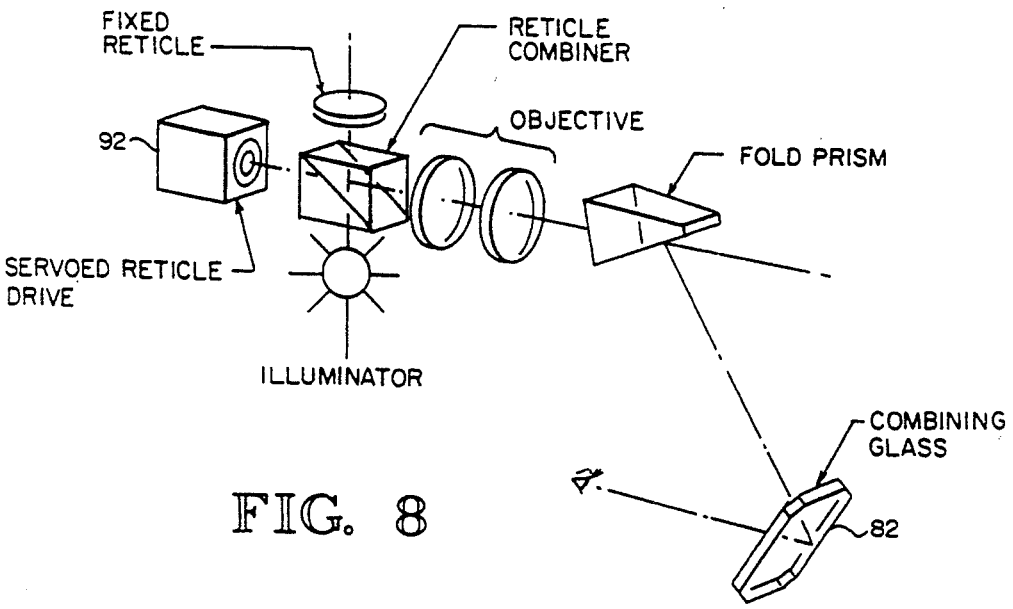
FIG. 8
FIG. 9
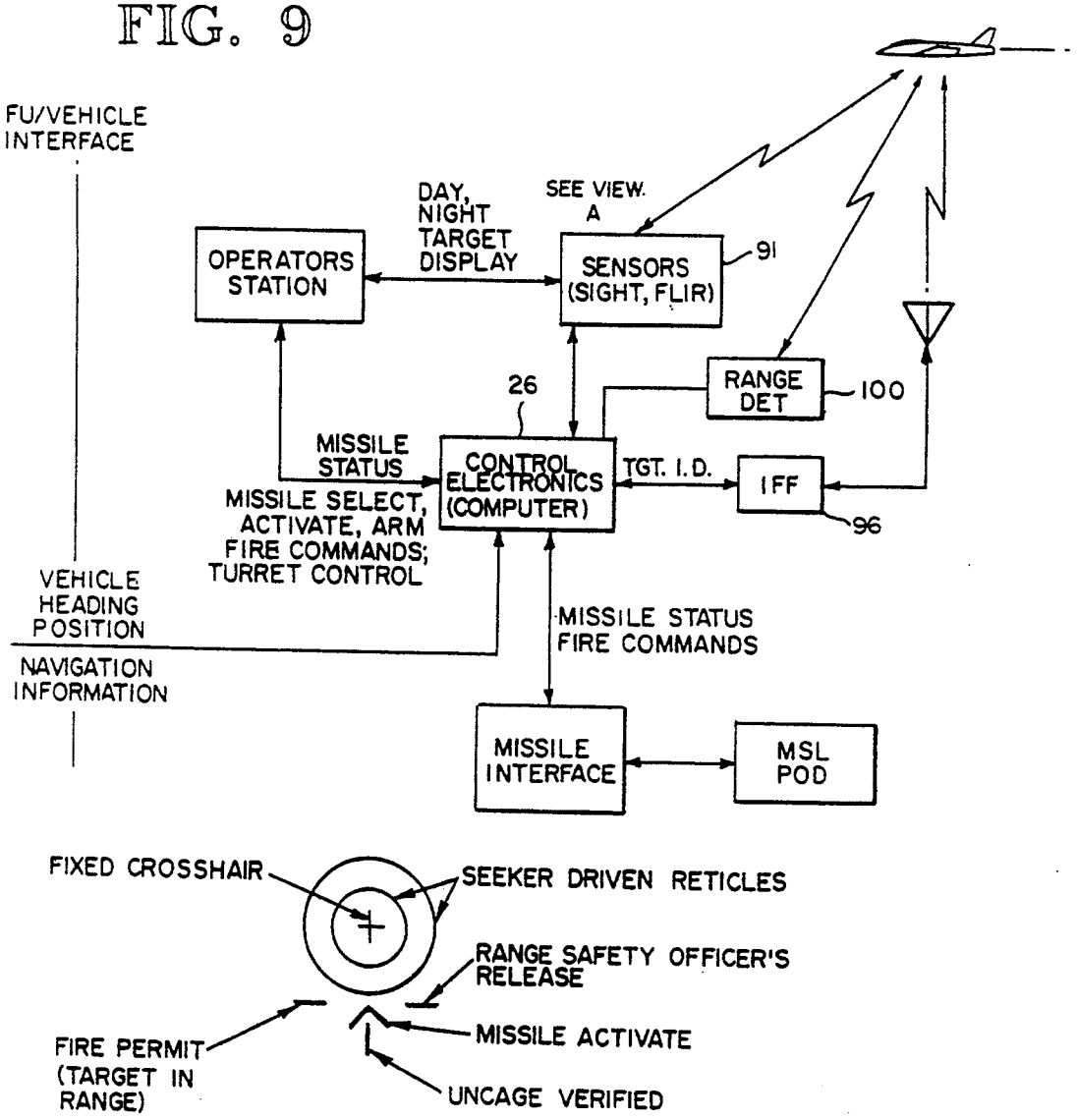

E

To FIG.13C cont.
Auto track selected ?
NO
Yes
Computer in control
Gunner in control
To FIG. 13C CONT.
Target in range ?
No
Continue track
Yes
RSO AUTHORIZE ?
No
Yes
RSO symbol on FLIR and sight
Fire Permit symbol on steady if in limits,or if no limits have been set
Flash Fire Perm. symbol on sight and FLIR
In Fire permit limits if set ?
No
Yes

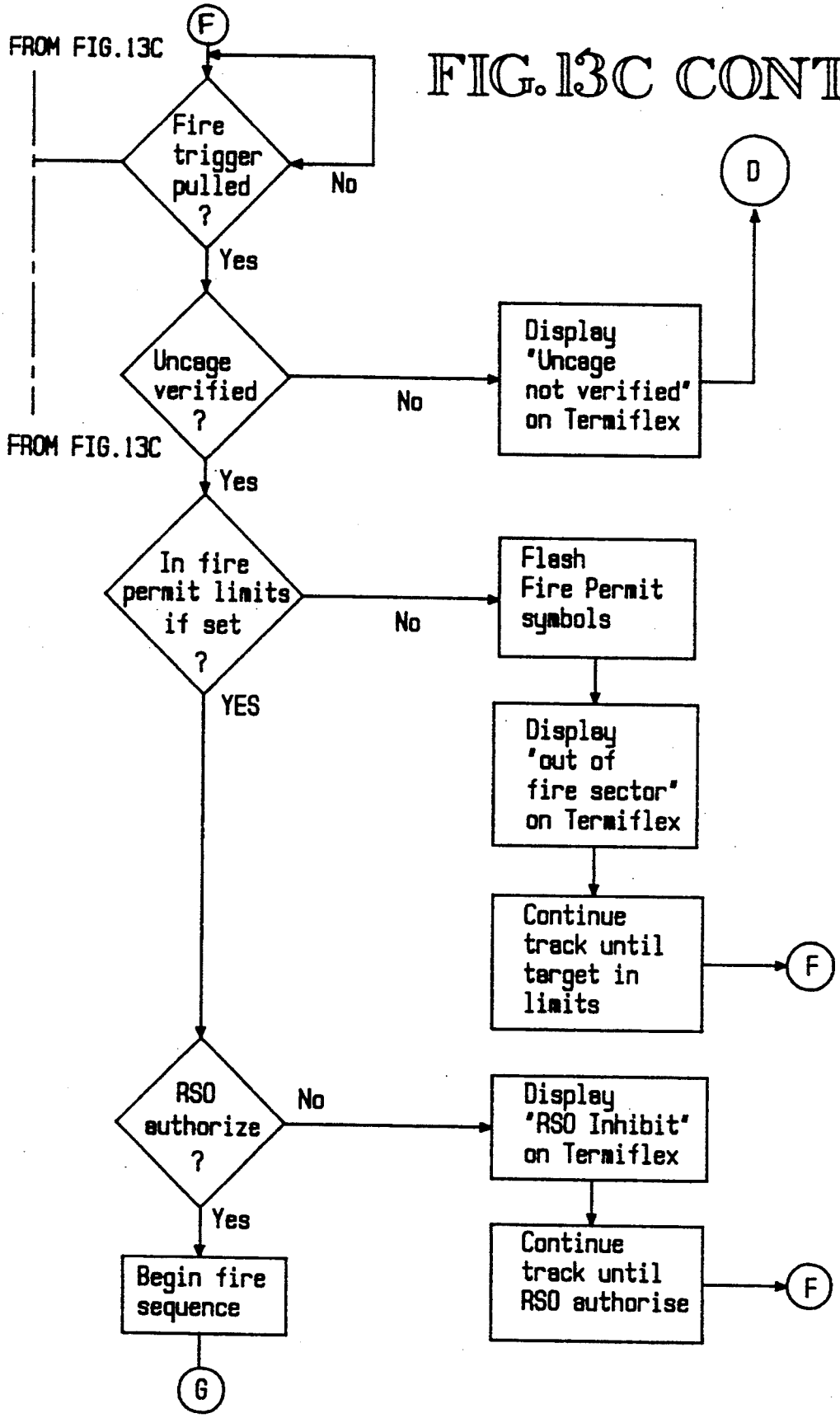
FIG. 13C CONT.
FROM FIG.13C
F
Fire trigger pulled ?
No
Yes
Uncage verified ?
No
Display "Uncage not verified" on Termiflex
D
FROM FIG.13C
Yes
In fire permit limits if set ?
No
Flash Fire Permit symbols
Display "out of fire sector" on Termiflex
Continue track until target in limits
F
YES
RSO authorize ?
No
Display "RSO Inhibit" on Termiflex
Continue track until RSO authorise
F
Yes
Begin fire sequence
G

TARGET ACQUISITION SYSTEM

BACKGROUND OF THE INVENTION

This invention relates to an airborne target acquisition system, and more particularly to a target acquisition system for a light air defense system for acquiring and engaging hostile airborne targets while the system is stationary, and particularly while it is on move, both in the day and at night, in clear, limited and adverse weather.

Prior art air defense systems were primarily of the active sensor type in which the target was acquired by radar signals and tracked by the same radar set. The prior art radar based air defense systems were succeptible to radar jamming by known chaff dispensing systems and active electronic warfare trickery which were designed to confuse the radar as to the identity and position of the target. They were also dangerously susceptible to active protection measures such as radar homing missiles which could simply home on the radar signal and destroy the radar station. If the radar station and the air defense installation happened to be in the same location the air defense installation was also vulnerable to attack by the same radar homing missiles.

Another disadvantage of radar based air defense system is that the attacking aircraft had ample warning that an air defense system was in place and operating well before they were in the range of the air defense system. This enabled them to take effective counter measures against such air defense systems, as described above, or to simply avoid that location.

Prior art air defense systems have typically been very costly and complex. The high cost of such systems limit the number which could be deployed because only a certain percentage of the funds in a defense budget is available for air defense. In addition, the prior art air defense systems where so complicated that the training of gunners was expensive and time consuming, so only a small number of gunners was trained and available to operate the system. If those gunners where absent because of illness or injury, the effectiveness of the air defense system was lessened.

The complexity and sophistication of prior art air defense systems also required a corresponding high degree of training and sophistication of the maintenance personnel and operations to keep the air defense system in operational readiness. In addition, many such systems had hardware, electronics and munitions that were specifically designed for the system and therefore required a spare parts inventory all of their own, further complicating the supply and maintenance situation.

It has long been a goal of the military community to develop an air defense system that utilizes only passive or near-passive sensors so as not to reveal the presence of the air defense system, and to develop an small lightweight air defense system that can be deployed quickly and procured inexpensively in large numbers. The target acquisition system of such a light air defense system must be simple and uncomplicated so that the gunners can be trained quickly and in large numbers, and so that the maintenance of such a system does not put excessive extra demands on the logistics of a flexible, fast moving fighting force. The target acquisition system must be extremely fast acting and self verifying so that the gunner is able to acquire targets, confirm their identity, ensure that the homing system is locked onto the target, and launch the munitions before the target has passed out of sight or located and destroyed the air defense system.

SUMMARY OF THE INVENTION

Accordingly, it is an object of this invention to provide a target acquisition system for a light air defense system having redundant sensors for acquiring targets in day light, night time and adverse weather, and for cross checking to confirm for the gunner that the target has been acquired and that the system is functioning properly. Another object of the invention is to provide a target acquisition system for a light air defense system which is compatible, with the small, unobtrusive and secluded nature of a light air defense system in a camouflaged or concealed situation. Still another object of the invention is to provide a target acquisition system for a light air defense system which can acquire and engage high speed airborne targets while on convoy or other moving maneuvers so that military assets in motion can be protected from air attack. Yet another object of the invention is to provide a lightweight easily deployable and inexpensive target acquisition system for an air defense system that utilizes to a large extent previously developed and existing sensors, hardware and systems. A yet further object of the invention is to provide a target acquisition system that contains redundant elements which can be used to cross check each other and also to independently acquire the targets if one of the other system is inoperative.

These and other objectives of the invention are attained in a preferred embodiment having a transparent sight glass mounted on an arm which is linked to the missile pods so that when the gunner looks through the sight glass, he is looking in the same direction that the missile pods are pointed. A projection system projects a reticle on the sight glass and the reticle projector is slaved to an infrared sensor/seeker which is employed in the missile, and/or the forward looking infrared scanner/seeker. The projection onto the transparent sight glass also includes symbology to inform the gunner whether firing authorization has been received, whether the missile has been activated, and whether the seeker has been uncaged. The projection on the sight glass also informs the gunner where the uncaged infrared scanner/seeker is pointed relative to the direction in which the gunner is sighting the turret to ensure that the missile and the turret are aimed at the same target.

DESCRIPTION OF THE DRAWINGS

The invention, in its many attendant objects and advantageous, will become better understood upon reading the following description of the preferred embodiment in conjunction with the following drawings, wherein:

FIG. 4 is an isometric view of the hand controller shown in FIG. 3:

FIG. 5 is a schematic diagram of the turret control system;

FIG. 8 is a schematic diagram of the reticle and display driver for the sight shown in FIG. 3;

FIG. 9 is a schematic of the missile fire control system;

DESCRIPTION OF THE PREFERRED EMBODIMENT

Figure 1:
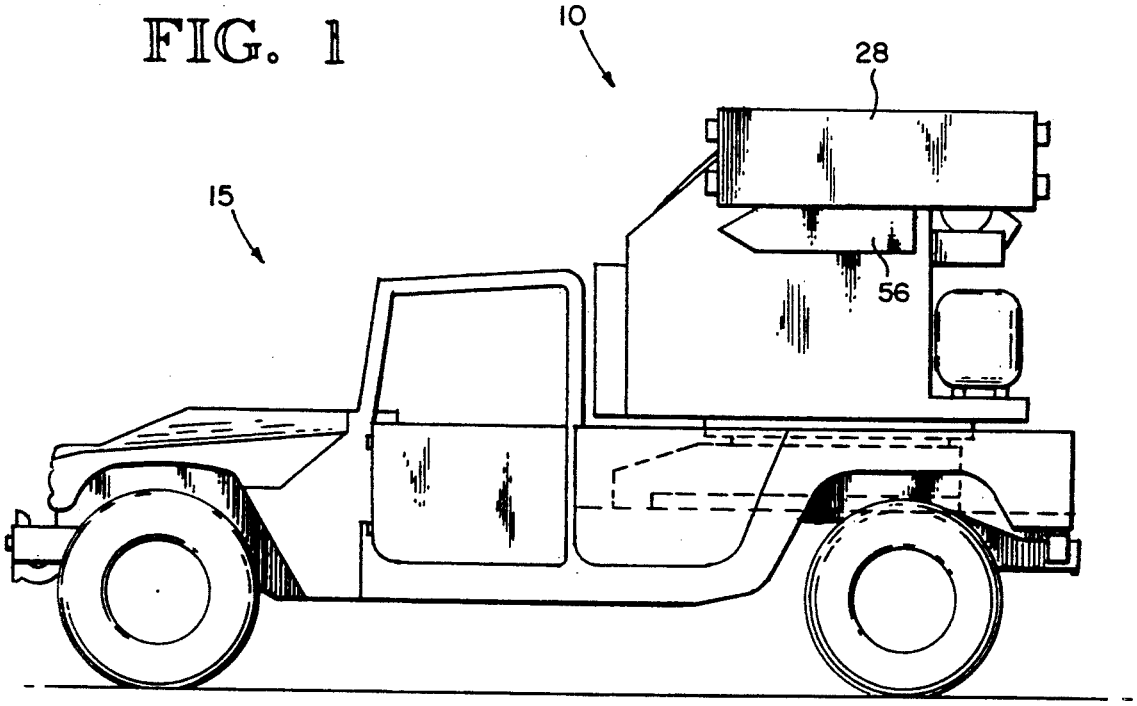
FIG. 1 is a side elevation of a light air defense system mounted on a mobile vehicle.

Turning now to the drawings, wherein like reference characters designate identical or corresponding parts, and more particularly to FIG. 1 thereof, a light air defense system is shown mounted on a mobile vehicle, such as a HMMWV. The HMMWV is a standard four-wheel drive military vehicle that is fast and agile over rough terrain. It's speed, range and agility make it an ideal carrier for a light air defense system although, until now, no light air defense system has been small or light enough, or adapted to the highly maneuverable HMMWV to be mounted thereon.

To be adaptable for carriage by the HMMWV the weight of the light air defense system must be substantially less than the maximum weight that the HMMWV can carry, and its center of gravity must be low enough so as not to create an unstable load on the HMMWV when it is traversing the steepest slope for which it is designed, at the maximum speed for that slope. Accordingly, it is necessary that the light air defense system, fully loaded with a full complement of gunner, operator, supplies and ammunition, have a center of gravity such that the desirable characteristics and mobility of the HMMWV are not adversely affected.

To this purpose, the light air defense system is designed so as to position the elements of greatest mass as low as possible and to distribute the mass of the rotating structure symmetrically about the vertical axis of rotation of the cabin so that the balance of the system is approximately equal regardless of the orientation of the cabin about its vertical axis. This mass distribution will be illustrated more clearly in the following drawings and also in the following description thereof.

Figure 2:
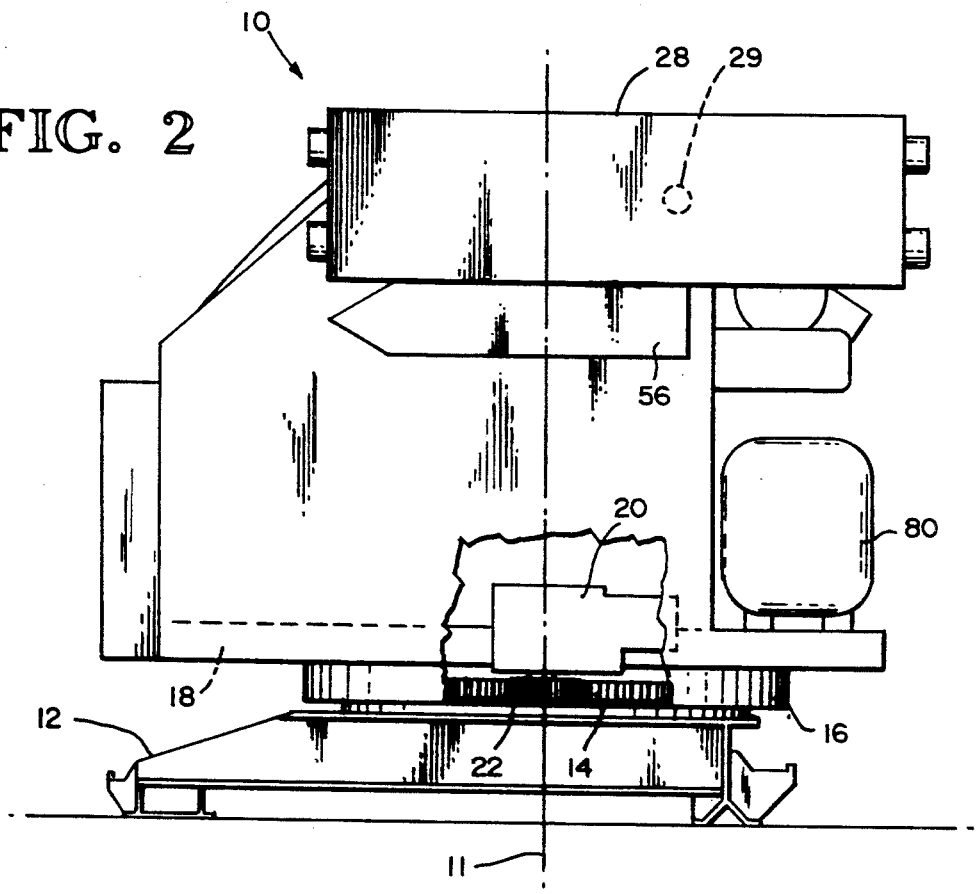
FIG. 2 is a side elevation of the light air defense system turret shown in FIG. 1.

The light air defense system turret includes a cabin 10 mounted for rotation about a vertical axis 11 on a base 12 by means of a ring gear/bearing 14. A height-adjustable seat 13 is mounted in the cabin for supporting a gunner in position to scan the sky through a transparent canopy 17. The base 12 is mounted on the bed of the HMMWV 15 by means of a self-aligning, quick attachment and release, mounting hardware shown partially in FIGS. 1 and 2, and more particularly described in the copending patent application for SELF-ALIGNING, QUICK DISCONNECT MOUNT filed concurrently herewith by William S. Riippi and John W. Rose, the disclosure of which is incorporated by reference herein.

The ring gear/bearing 14 supports the cabin 10 for rotation about the vertical axis 11 by way of the outer bearing race 16 fastened to the under surface of the cabin substructure 18, as more particularly shown in the aforesaid patent application of Riippi et al. An azimuth drive motor 20, supported by the cabin substructure 18 has a depending pinnion 22 engaged with the ring gear 14 fixed to the base 12, whereby the cabin may be rotated about the vertical axis 11 on the base 12. The drive motor 20 is energized to rotate in one direction or the other, depending on the desired direction of rotation, by a power supply and turret control unit 24 under the command of a control system 26 mounted in a gunners console 27.

A pair of munitions arms 28 is mounted on the cabin 10, one on each lateral side thereof, for rotation about a horizontal axis 29. A horizontal, transversely extending torque tube 30 extends between and connects the munitions arms 28 to each other so that they elevate synchronously, one with the other. A sector gear 32 is keyed to the torque tube 30, and an elevation drive motor 34 having a pinnon 36 engaged with the sector gear 32 drives the torque tube for rotation about its axis. The drive motor 34 is supported on a bracket 38 which hangs from the torque tube 30 by way of journal bearings, and is coupled to the cabin frame at the other end of the bracket and spring biased against the sector gear 32 so that the motor stays in contact with the sector gear regardless of deflections of the torque tube while the vehicle is in motion over rough terrain. In this way, the elevation drive motor 34 can reliably drive the sector gear 32 and rotate the torque tube in whatever direction is desired at all times. The drive motor 34 is energized by the turret control unit 24 under control of the control means 26. An optical sight 40 is linked to the torque tube 30 as shown more particularly in the copending application of Riippi and Rose, entitled TORQUE TUBE ELEVATION DRIVE MEANS filed concurrently herewith, the disclosure of which is incorporated herein by reference.

A gyroscope 42 is mounted on the torque tube 30 for sensing the rate of rotation of the torque tube 30, and hence the munitions arms 28. Another gyroscope 44 is mounted on the frame of the cabin for sensing rate of rotation of the cabin about its vertical axis 11. The torque tube gyro 42 and the cabin gyro 44 are connected by conductors (not shown) to the control means 26 to provide the control means with data about the elevation and azimuth angular acceleration of the munitions arms 28 relative to the position of the vehicle.

Figure 3:
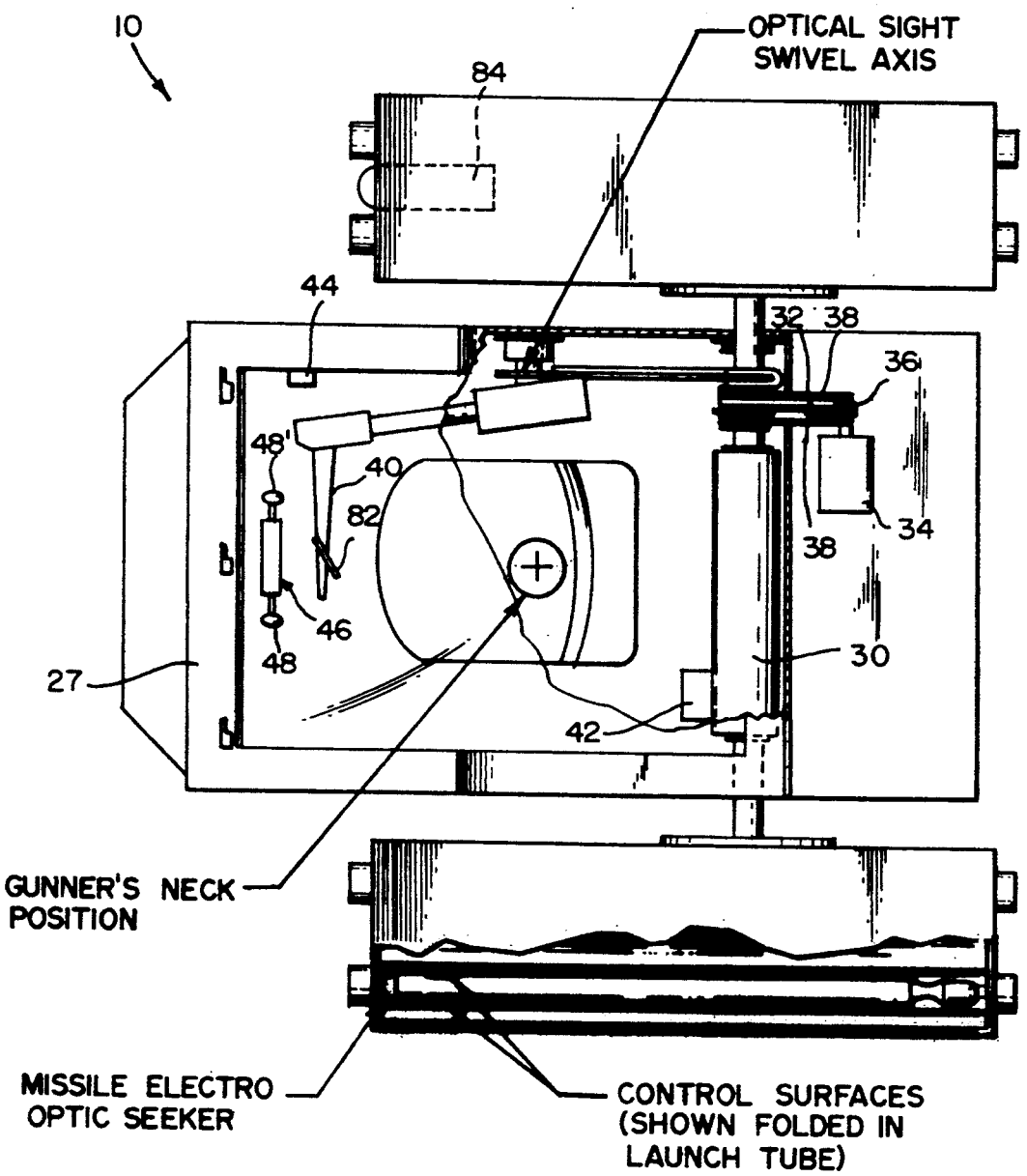
FIG. 3 is a plan view of the cabin showing the gunner's seat, the sight, the FLIR screen, and the hand controller.

A hand controller 46 is provided in the cabin 10 to enable the operator to operate the azimuth and elevation drive motors by manual controls. The hand controller, shown in FIG. 3 and more particularly in FIG. 4 has two hand grips 48 and 48' projecting laterally from two sides of a body 50. The hand grips can be rotated together about a laterally extending horizontal axis 52, and the body 50 can itself be rotated about a fore-and-aft horizontal axis 54 orthogonal to the horizontal axis 52 of the hand grips 48 and 48' by rotating the hand grips about the axis 54. Rotation of the hand grips about their axis of rotation 52 causes the arms to nod or elevate about their horizontal axis of rotation, and rotation or revolving the handgrips 48 and 48' about the axis 54 causes the azimuth drive motor to drive the turret in the counterclockwise direction (looking down) when the hand controller is rotated in the counterclockwise direction (looking forward) and visa versa.

A forward looking infared (FLIR) scanner/seeker 56 is mounted on one of the munitions arms 28 and pointed in the same direction that the missile are mounted on the munitions arms are pointed. A screen in the cabin 10 produces an image of the infrared view scanned by the FLIR scanner/seeker to give the gunner an infrared view of the section of the sky in which the missiles are pointed. In this way, the light air defense may be operated at night almost as effectively as in the day time.

The FLIR scanner/seeker has a mosaic of infrared detectors which is scanned electronically for infrared signals. When a signal is detected, the image appears on the screen 88 in cabin 10 at the position corresponding to the position on the infrared detected mosaic where the infrared image is focused.

The signal from the FLIR scanner/seeker can be used in an automatic tracking mode to drive the cabin and arm drive motors. The detector mosaic is laid about two orthogonally centered X-Y axes and an infrared image which is not centered on the X-Y axes produces off-axis X signals and/or off-axis Y signals which are used by the control means 26 to produce signals to the drive the turret control unit 24 to operate the drive motors 20 and 34 to rotate the cabin and elevate the munitions arms to center the FLIR scanner/seeker on the infrared image. In this way, the signals from the FLIR scanner/seeker can be used to automatically control the turret so that the turret automatically follows the target across the sky.

There is an infrared seeker mounted in the STINGER missile nose which produces elevation and azimuth error signals to control the missile fins so that the missile automatically follows an infrared source on which it is locked. The error signals in the STINGER seeker can be used by the control means to automatically control the cabin drive means and the munitions arm elevation means to follow the target across the sky in the same manner that the FLIR error signals are so used.

A static azimuth sensor 58 provides precise information as to the azimuth of the cabin and a static elevation sensor provides information about the elevation of the arms. The static azimuth sensor includes an optical disk (not shown) having concentric rings, each marked with regularly alternating light and dark areas. The light and dark area repetitions double in number with each succeeding ring. The azimuth sensor disk is optically scanned to produce a unique signal for each sector of angle. An eight ring array will produce a unique signal for each sector of 1.4°; a nine ring array will produce a unique signal for each sector of 0.7°.

The static position sensor 59 for the torque tube 30 is a d/c potentiometer having a stationary pickup in contact with a coil mounted on the torque tube. The d/c signal produced by the potentiometer is directly proportional to the angle of the munitions arms above the horizontal. The cabin azimuth and arm elevation can be displayed on the gunner's console in the cabin 10. The position indicating signals are also inputted to the control means 26 as discussed below.

Figure 6:
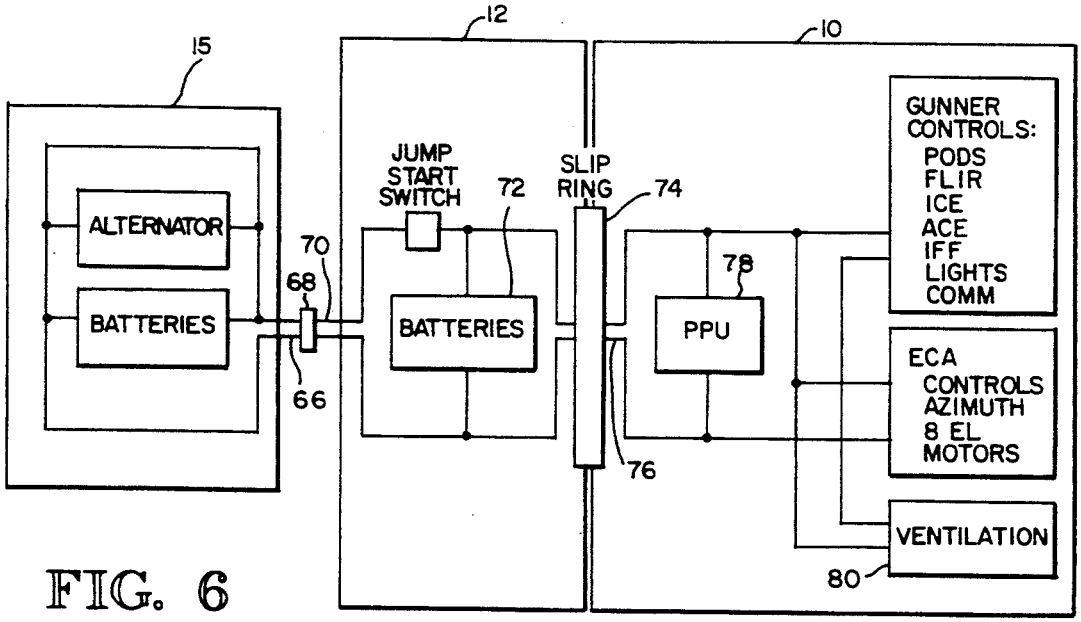
FIG. 6 is a schematic diagram of the power generation, storage, and distribution system for the turret shown in FIG. 2.

A power system for provided electrical power to the light air defense system shown in FIG. 1 is shown schematically in FIG. 6, and includes a conventional alternator and battery combination in the vehicle which is connected by a cable 66 and a connector 68 to a cable 70 on the LADS. A set of batteries 72, sufficient to enable operation of the LADS for at least 45 minutes with the air conditioner operating, and over two hours without the air conditioner, is connected in parallel to the power cable 70. The cable is electrically connected, by way of a slip ring assembly 74, to the main power cable 76 of the cabin 10. A prime power unit 78 is connected in parallel to the main power cable 76 and provides electrical power for operation of the LADS and also can provide power for the electrical system of the vehicle back through the slip ring 74 in the event that the vehicle electrical system is inoperative. The prime power unit 78 is a diesel engine powered electic generator having a three kilowatt capacity, consuming fuel at about 0.7 pounds per kilowatt-hour. The fuel tank capacity is 34 pounds which provides more than enough fuel to operate the system for 24 hours of a high intensity aerial assault scenario.

The parallel connection between the vehicle electrical system and the LADS electrical system provides redundant electrical capability for operating the LADS in the event that its fuel tank is exhausted or its electrical supply system becomes inoperative.

An electrically operated air conditioner unit 80 is mounted on the rear platform on the fuel tank for the prime power unit 78. The air conditioner unit 80 is connected in an air circulation system for the cabin 10 which includes a vent which can be open to allow circulation of fresh air through the air conditioner into the cabin 10, or can be closed to allow a closed loop circulation of air within the cabin and through the air conditioner to prevent the entrance of air from outside the cabin when such outside air would inimical to the well-being of a gunner, such as when the missiles are fired or when the LADS is operating in an area under enemy attack using gas or biological warfare agents.

Figure 7:
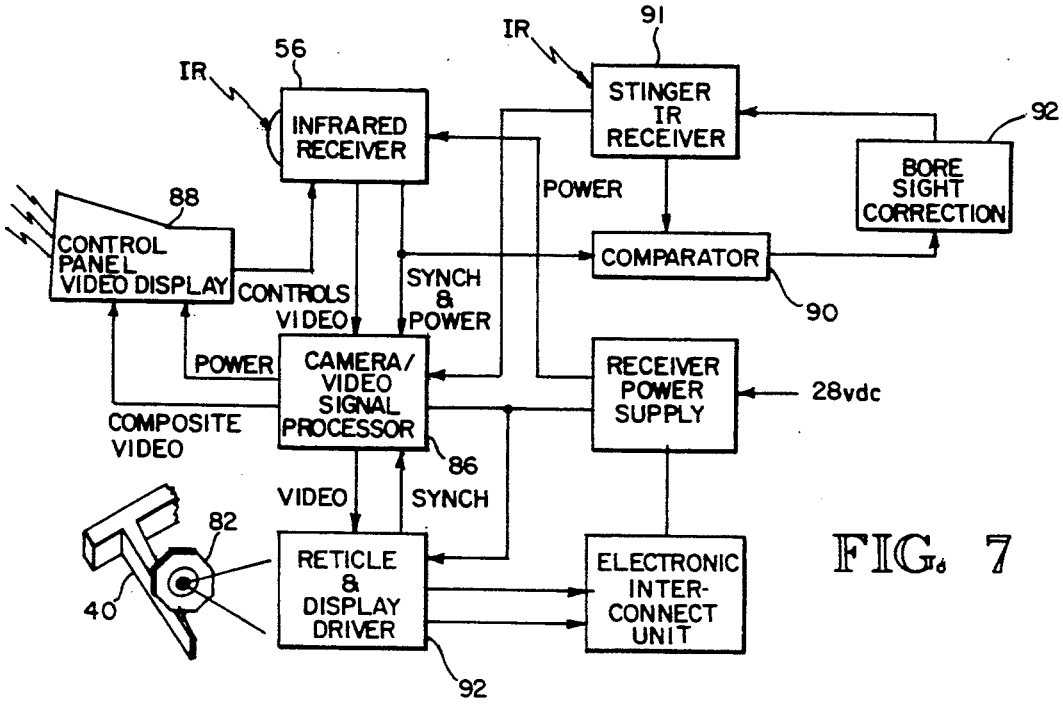
FIG. 7 is a schematic diagram of the target acquisition system showing the visual and video optics and the FLIR.

The target acquisition system is shown schematically in FIG. 7. The system includes an optical/visual sight 40 and a forward looking infrared sensor/seeker 56. The two systems are combined in a heads-up transparent sight glass 82 to enable the gunner to coordinate both the target acquisition system and the automatic tracking system to be described below in an integrated manner so that the operation of the LADS is fast and uncomplicated.

The optical/video target acquisition system uses a video camera 84 in one of munitions arms 28 pointed in the same direction that the munitions and the arms are pointed. The camera 84 has at least two fields of view so that the gunner may use the wide field of view for first acquiring a target and then a narrow field of view for precise tracking. The image produced by the video camera 84 is displayed on a screen 88 in the cabin and also can be projected on a transparent sight glass 82 which is linked to the sight arms so that the sight glass is raised and lowered in synchronism with the munitions arms 28. The mechanism for controlling the angle of the sight arm and synchronizing its movement with the missile arms 28 is shown more particularly in the aforementioned co-pending application of Riippi et al. entitled TORQUE TUBE ELEVATION MECHANISM.

A driven reticle projector is shown in FIG. 8. The projector includes a servoed reticle drive driven by the signals from the scanner/seeker. It projects a reticle on the sight glass so that the gunner has the confirmation that the scanner/seeker in the missile or FLIR and his own visual line of sight through the sight glass are aligned. When the gunner is satisfied that the scanner/- seeker is aimed at the target which he has selected, he can uncage the seeker which will then automatically track the target. The driven reticle driven from the azimuth and elevation error signals from the seeker confirms for the gunner that the missile seeker remains locked on the target that the gunner has selected. If the driven reticle and the optical image begin to diverge, the gunner can then recage the seeker so that he can force it back onto the target which has selected.

The preferred munitions for the LADS disclosed is the STINGER missile made by General Dynamics. The STINGER missile has an infrared sensor/seeker which produces azimuth and elevation error signals that are used by the missile to control the missile fins so that it can home in on a infrared-emitting target. These elevation and azimuth error signals can also be used by the LADS for the same purpose mentioned above and can also be used for manual or automatic bore sight correction in a system shown in FIG. 7. Bore sight correction is the correction of the slight misalignment of the missiles or missile optics in the missile pod, which causes them to be launched slightly misaligned from the target direction. This usually does not cause a problem but occasionally a missile will miss the target because it looses contact with the infrared signal because of the combination of the bore sight misalignment and the misalignment incurred by reason of the low speed and low temperature STINGER boost launcher.

As shown in FIG. 7, the FLIR 56 produces a signal to a signal processor 86 which converts the FLIR signal to a visual image which is sent to a video display 88 in the cabin 10. The FLIR image is also sent to a comparator 90 in which the FLIR image is compared to the image which is produced by the STINGER infrared sensor/-scanner 91 to produce an error signal which is sent to a bore sight correction unit 92, which aligns the STINGER missile accurately within the launch pod. The signal from the signal processor 86 is also sent to a reticle and display driver 92 shown schematically in FIG. 8, which aims the visual image corresponding to the infrared image to be protected by the FLIR or the Stinger seeker 91, or both, on the sight glass 82. When the sensor/seeker is uncaged so that it can follow the target, the image will be projected on the sight glass at a position corresponding to the position of the target relative to the aiming point of the missile pods. In this way, the gunner can be informed as to the exact position of the infrared target and can correct the aiming position of missile pod by use of his hand station.

The missile fire control system, illustrated in FIG. 9, is under the overall control of the control means 26 which initiates all missile preparation actions and reserves for gunner action only those functions requiring human judgement. Specifically, the missile sensor/-seeker 91 produces a signal which is conditioned by the control electronics 26 to produce a display on the sight glass so that the gunner can tell what target the missile sensor/seeker is locked on after the sensor/seeker is uncaged. The contol electronics also initiates the IFF interrogation signal from the IFF unit 96 and confirmation of the response. The interrogation signal and the inhibition of missile fire until confirmation of enemy identity is controlled automatically and very rapidly by the control electronics in the missile fire sequence or when initiated manually by the gunner.

The missile fire sequence is controlled by the control system 26 in an automatic sequence that reduces the missile firing time to less than one quarter of the time required for the "manpad" firing mode. During manual tracking and when automatic tracking is initiated, the contol electronics continuously samples and stores the elevation and azimuth tracking rates. When the gunner has acquired a target, he activates a missile by pushing the missile activate button. The contol electronics causes the pre-selected bore sight correction to be inserted or, if the FLIR bore sight correction scheme is employed, it is used to correct any bore sight misalignment. The control electronics 26 causes the missile gyroscope to be spun up and missile seeker/sensor 91 to be cooled so that it can sense infrared targets. A missile tone is audible to the gunner through his helmet earphones and the gunner can center the turret aiming point on the infrared target at a position which maximizes the tone. At that point, the gunner sqeezes the missile uncage trigger, which uncages the missile and the uncage verify tone is heard by the gunner in his earphones.

If the gunner has not yet switched his safe/on switch to On, the control electronics flashes an image on the display console to warn him that the missile is not armed. The gunner then switches the switch to the ARM position and the SAFE light goes off, and the ARM light goes on.

With the missile uncaged, the gunner can now switch to missile autotrack which disables the hand controller and switches the azimuth and elevation drive control to the control electronics 26. When the gunner presses the fire button on the hand contoller, the control electronics compares the azimuth and elevation inputs with any preselected fire control limits recorded in the memory and, if the missile pods are out of the authorized fire sector, the firing sequence will be halted and the display will appear on the console "out of fire sector". The missile pod will continue to track the target until it is either out of range or within the target limits.

The control electronics then clears whether the range safety officer has authorized missile firing. If not, the message on the console will flash "RSO inhibit" and the target will continue to be tracked. If the range safety officer has authorized firing, the computer then queries whether the target is a helicopter or a fixed wing target. Depending on whether it is helicopter or fixed wing, and whether the target is moving to the right or to the left, the computer inserts the correct lead angle for the optimal accuracy for the missile. The elevation and lead angle are inserted automatically by a signal from the control electronics 26 to the azimuth and elevation motor controls 24 which cause the missile pods to lead the target by the correct amount. The computer signals to the air conditioner to close the vent so as to prevent inhalation of missile exhaust into the cabin. The fire command is issued to the missile which activates the heat battery, which is a chemical battery having a life of 30 seconds or so to provide power to the missile electronics and actuators. When the missile battery is up to temperature and producing full voltage, the control electronics issues the missile booster fire command which causes the electrical umbilical to be jerked loose from the missile and the missile booster to be fired. The missile booster ejects the missile from the pod and, when it is clear of the pod, the missile rocket motor fires and propels the missile toward the target under control of the missile seeker.

The contol electronics selects the next missile to be activated and activates that missile. The gyroscope in that missile is spun up and the sensor cooled and at the same time super elevation and lead are removed so that the turret returns to the position it would have had, had the tracking continued. The gunner hand controller is reactivated so that the turret tracking is again under the control of the gunner. The gunner verifies visually that the target has been destroyed and immediately slews the turret to engage the next target.

Figure 10:
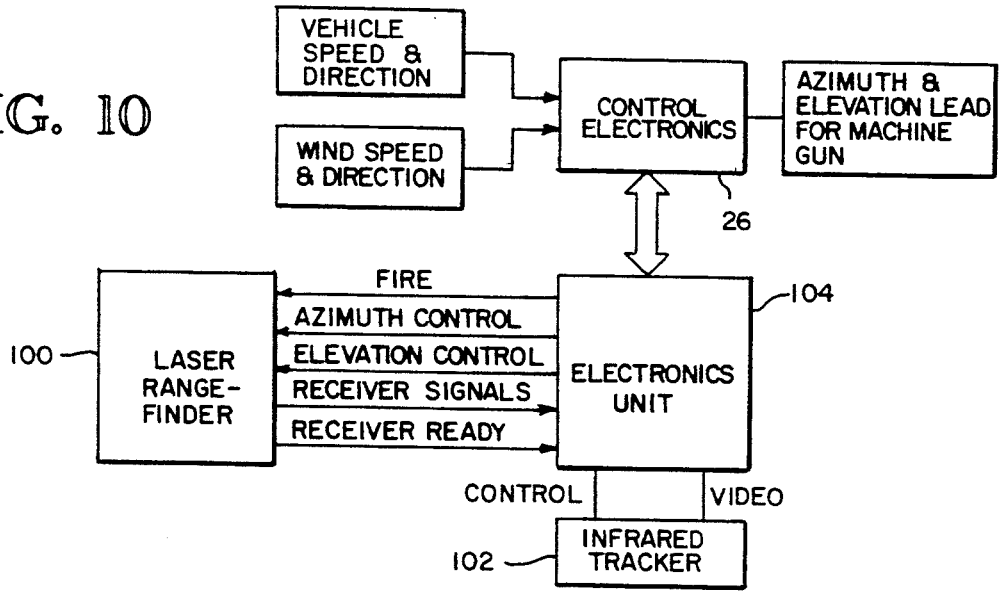
FIG. 10 is a schematic diagram of the laser range finder system.

A laser range finder 100, shown in FIG. 10, uses a $CO_2$ laser having a narrow beam transmission to minimize interception and detection by attacking enemy units. The narrow beam of the laser would ordinarily make its use on an air defense system impractical, but the extremely stable platform provided by the turret stabilization system of this invention makes the use of the laser rangefinder feasible. An infrared tracking unit which rapidly scans a 2° by 2° field of view provides target information to the control electronics which in turn generates beam steering commands to direct the laser range finder beam very accurately to the target. This resolves the aiming problem of the convention laser range finder. The laser range finder includes a sensor which measures the light transmission time and provides extremely accurate information as to the range of the target from the laser range finder.

The laser range finder is integrated into the control electronics to provide an inhibit signal when the target is detected to be out of range of the missile. In addition, the control electronics can calculate, from the range information provided by the laser range finder and also the azimuth and elevation rates of change, the course of the target and the anticipated interception position so that the missile can be fired at the earliest possible time to engage the target as far as possible from the light air defense system.

It is anticipated that the LADS of this invention may be provided with a high rate of fire machine gun for close engagement. The laser range finder is particularly useful for providing information to the control electronics to calculate the proper elevation and lead angles for the machine gun to provide unerring accuracy to the automatic elevation and azimuth lead controls when a machine gun is to be used. Further refinement may be included by providing an input for wind velocity and direction input to the control electronics, and also vehicle motion sensors for inputting the speed and direction of the vehicle into the control electronics. In this way, the corrections for wind velocity and also for vehicle motion may be accommodated.

It is desirable in many circumstances to operate the LADS turret from a remote position. The remote position may be as close as the vehicle cab and as far away as a fortified bunker at some distance from the turret. In addition, it is useful to provide the capability of monitoring the controls and displays of the turret from a remote position for purposes of training.

Figure 11:
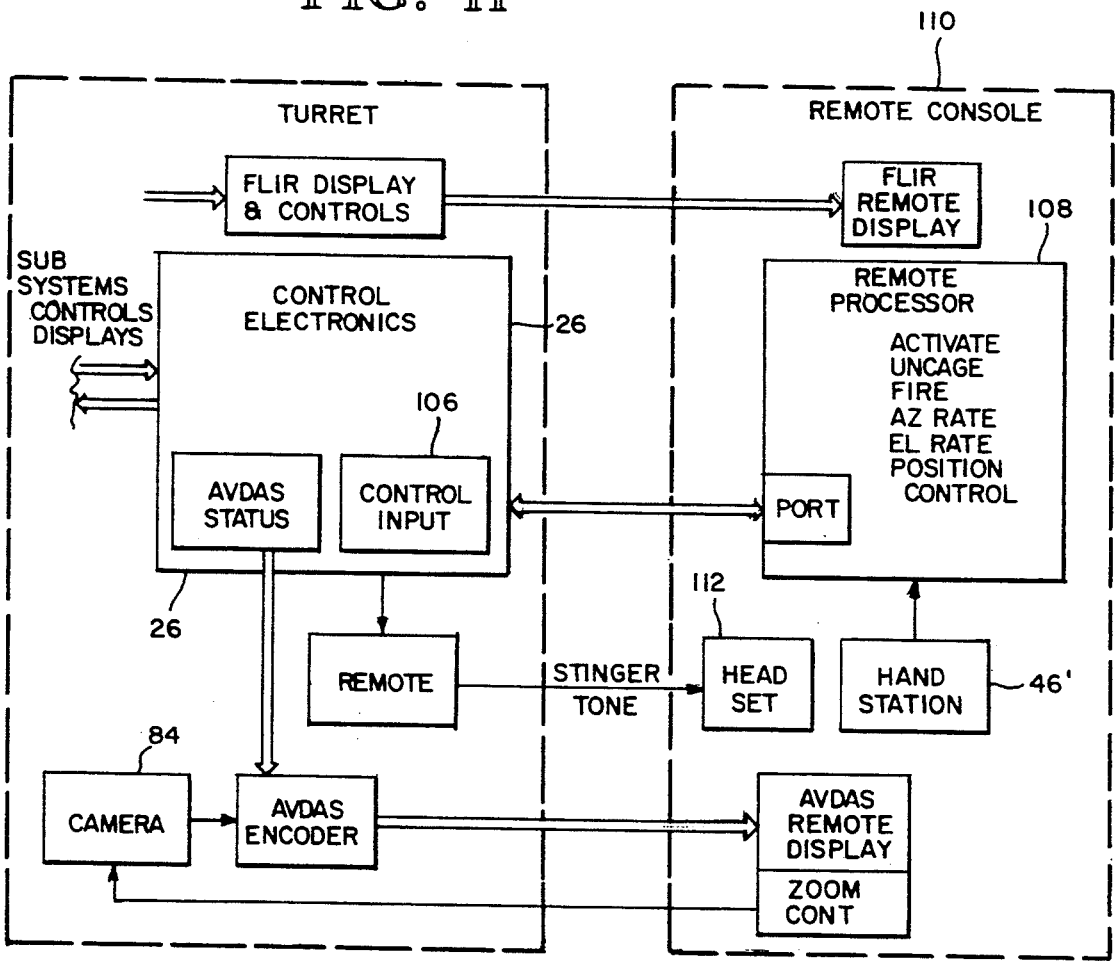
FIG. 11 is a schematic diagram of the remote control and monitoring system of the light air defense system shown in FIG. 2.

A remote control system for the LADS is shown in FIG. 11. As shown, the remote control communications are by way of cable, but it could be done by other forms of communications such as radio and laser communication.

The remote control system uses a standard computer interface, such as an RS232, which is cable connected to a similar RS232 port on the remote processor 108 which enables the remote console 110 to control the functions of the control means 26 from the remote console. The remote console 110 can be an exact duplicate of the console in the cabin 10 or it can be a suitcase type which can be carried either in the vehicle cab or located in a central command and control center. The hand controller 46' of the console 110 is identical to the hand station in the cabin console and is operated identically to the cabin hand station 46. These signals from the hand station are sent via the cable to the control means 26 in the cabin which functions as though the gunner were in the cabin. A headset 112 is provided which will give the remote gunner the same audio signals that the gunner in the cabin would have received. Since the gunner is not actually in the cabin, his visual acquisition of the target will have to depend on the camera 84 in the missile pod, which is inferior to direct line of sight acquisition of the target, but in some circumstances is preferred to a direct line of sight form. Likewise, the FLIR image can be displayed on the remote video display screen by way of signals over the cable to the remote display. Once a target is acquired by a particular LADS system, the on-board auto track function can be initiated for automatic target tracking. The auto track can be accommplished using either the missile seeker or the FLIR contrast tracking functions. The FLIR display and the video camera image can both be displayed in the control center for visual target recognition. The firing of system missiles or other air defense weapons can be controlled from the control center. This flexibility enables the use of the LADS without subjecting the operators to the danger of air attack from attacking aircraft, and also enables larger weapon systems, such as large guns or large rocket pods that would otherwise cause a weight or volume problem on vehicle mounted applications to be utilized.

Figure 12:
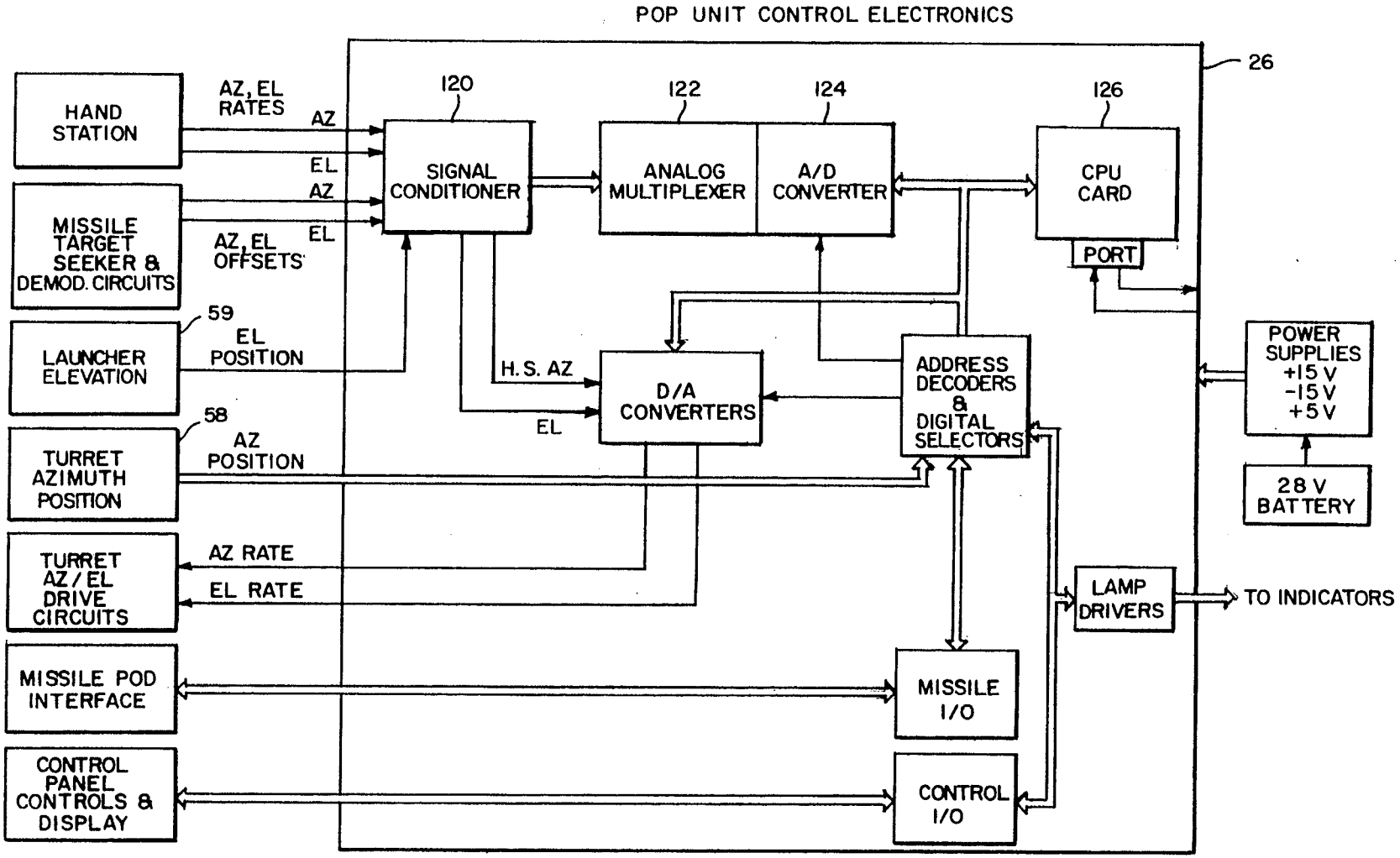
FIG. 12 is a functional schematic diagram showing the relationship between the sensor, drives, controls, armament and computers of the LADS shown in FIG. 2.
Figure 13A:
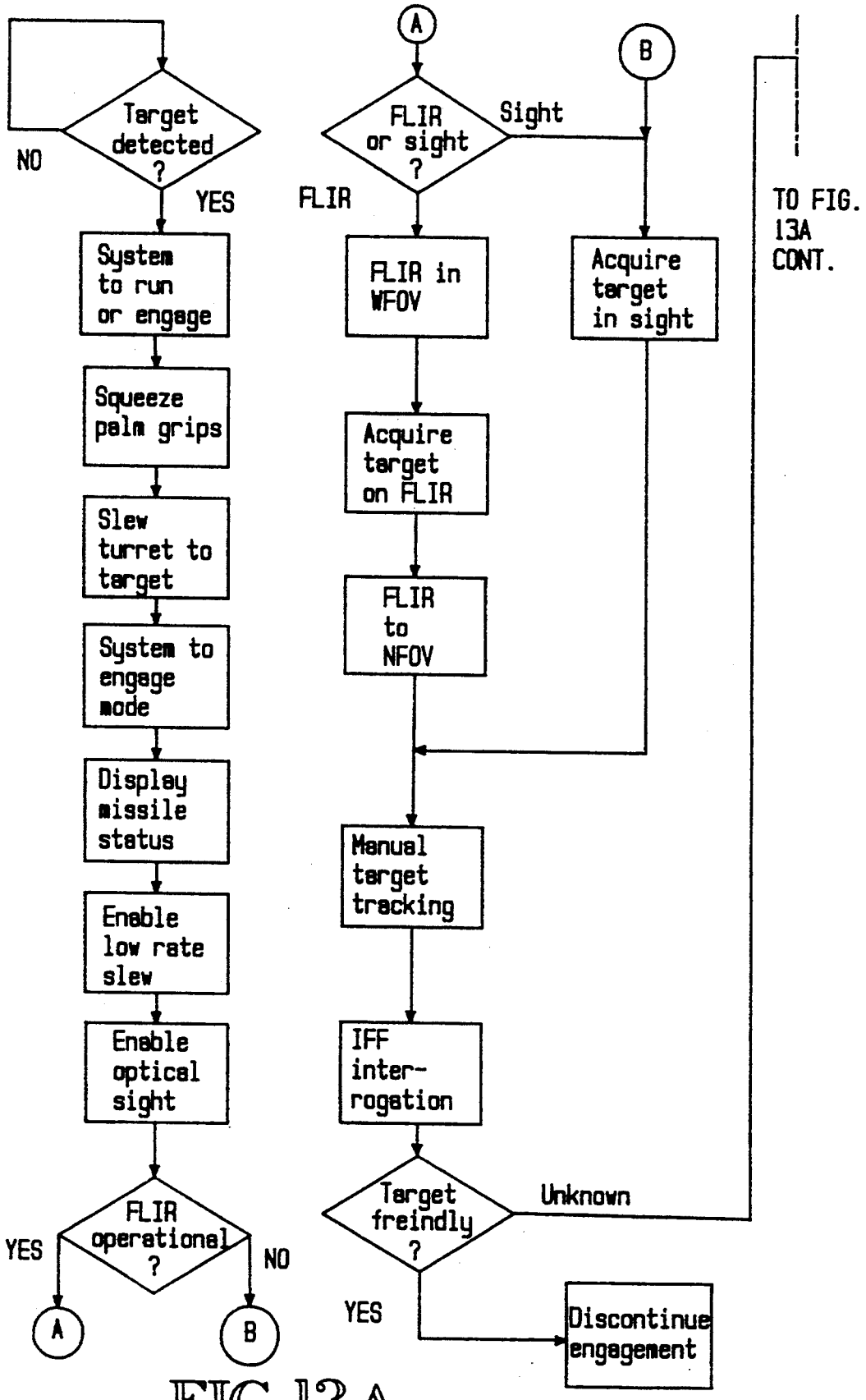
FIG. 13 is a logic flow block diagram of the sequence of operations and decisions of the gunner/system combination.
Figure 13A:
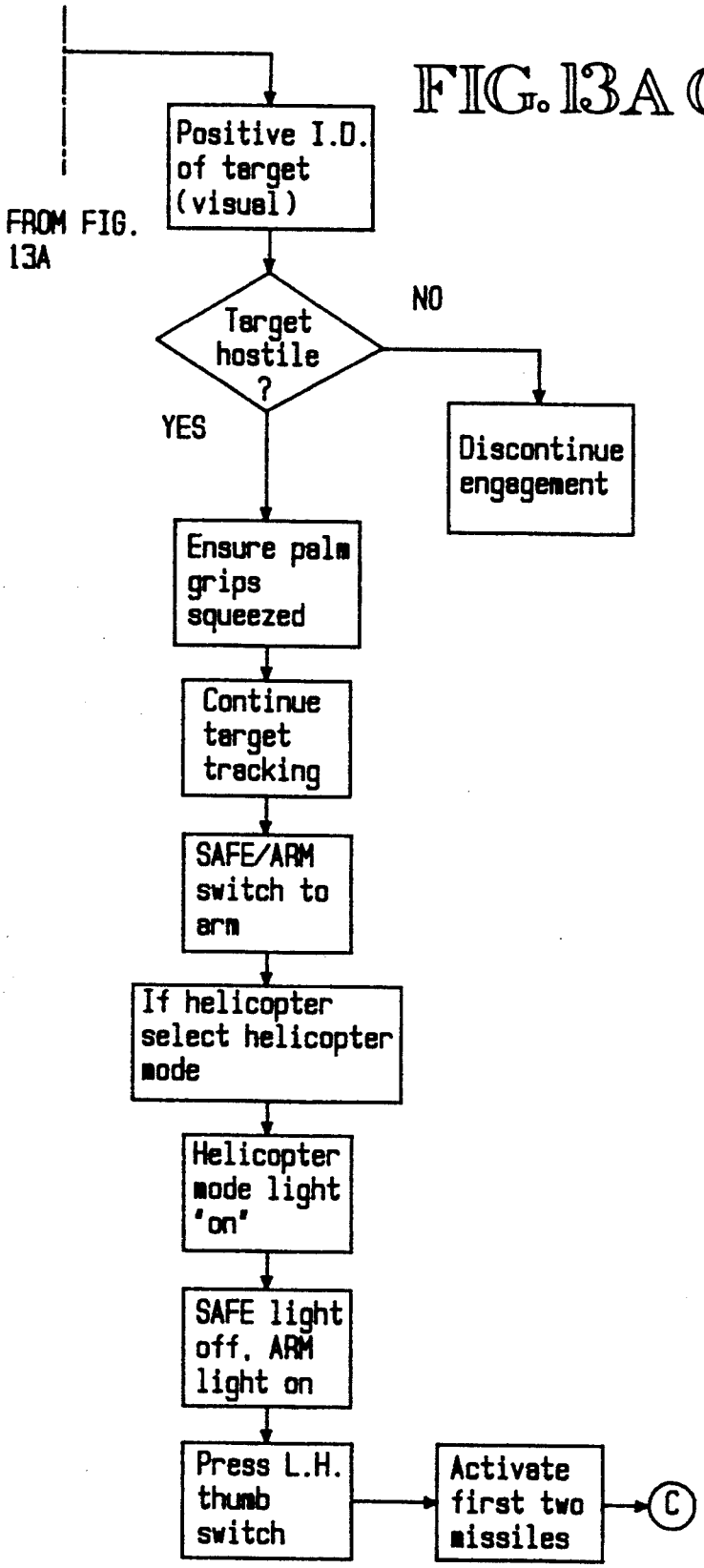
Figure 13B:
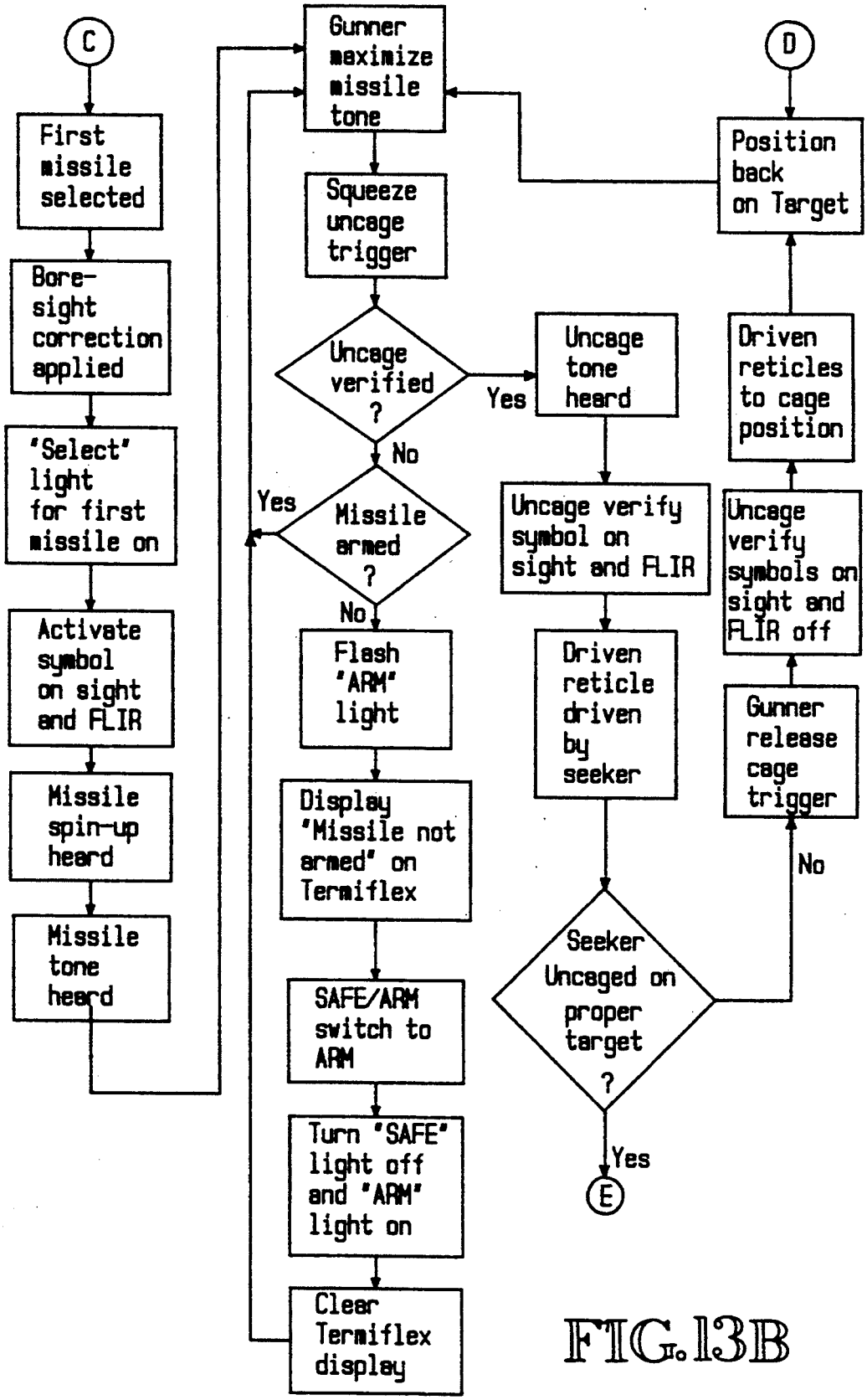
Figure 13C:
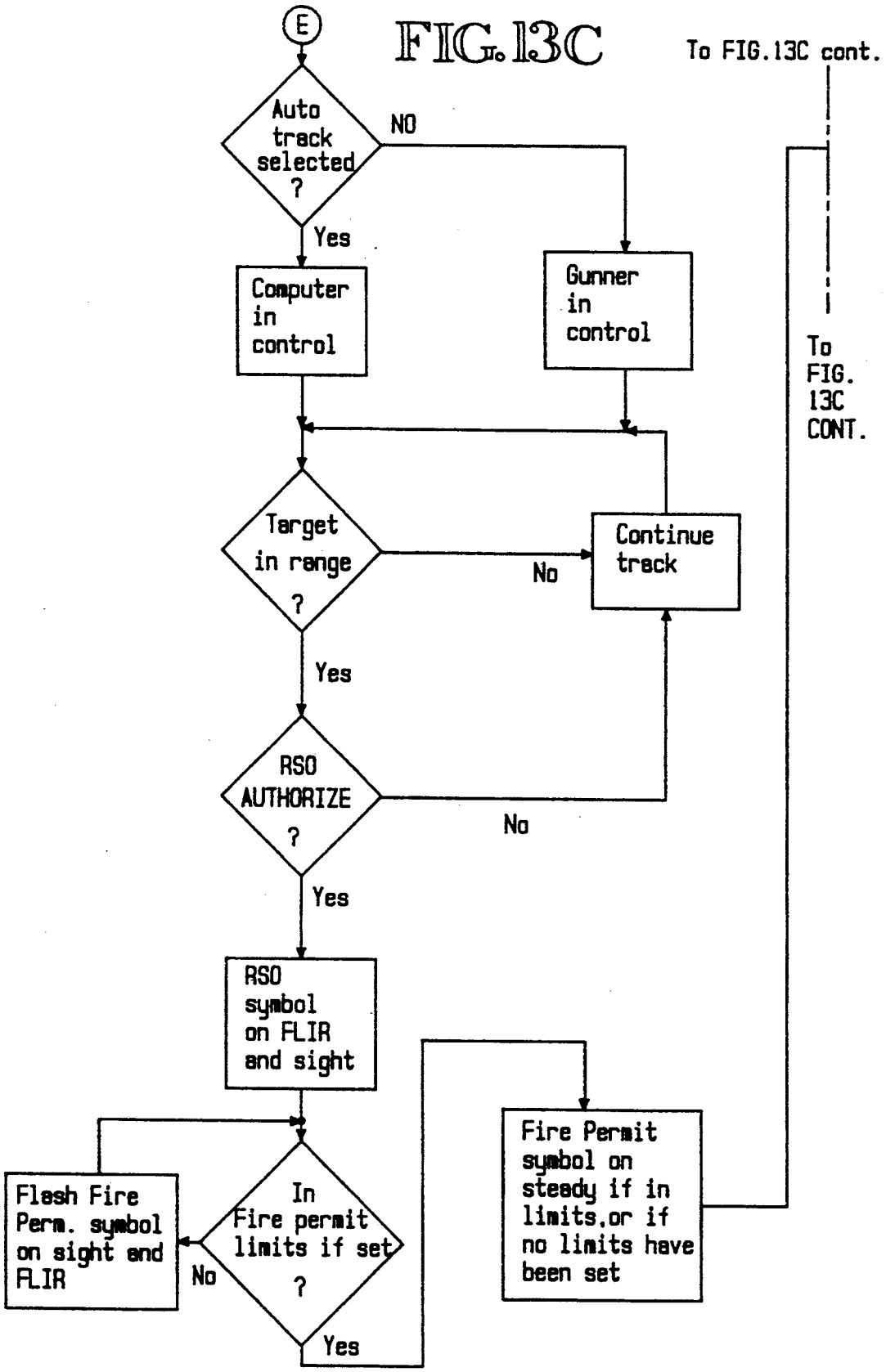
Figure 13D:
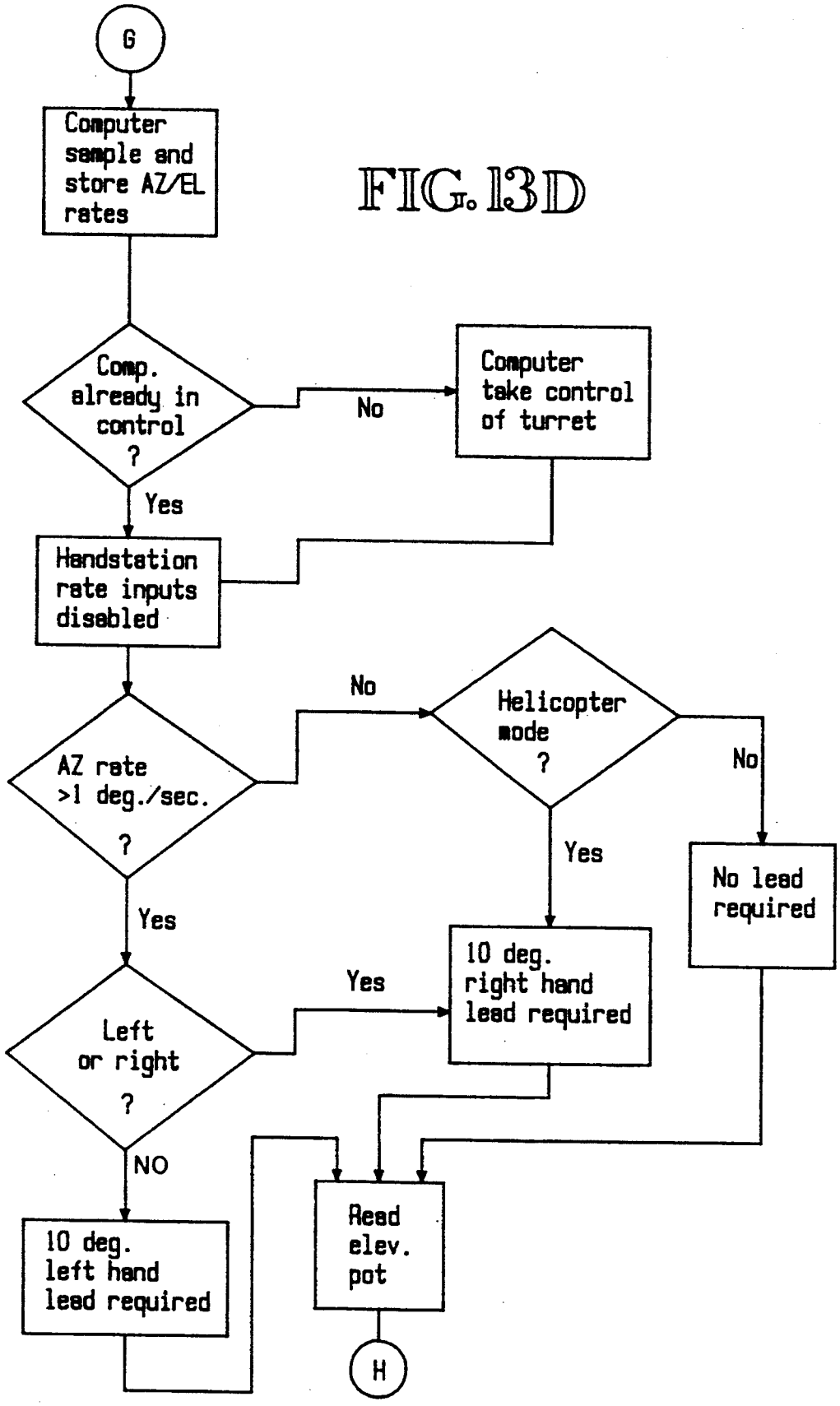
Figure 13E:
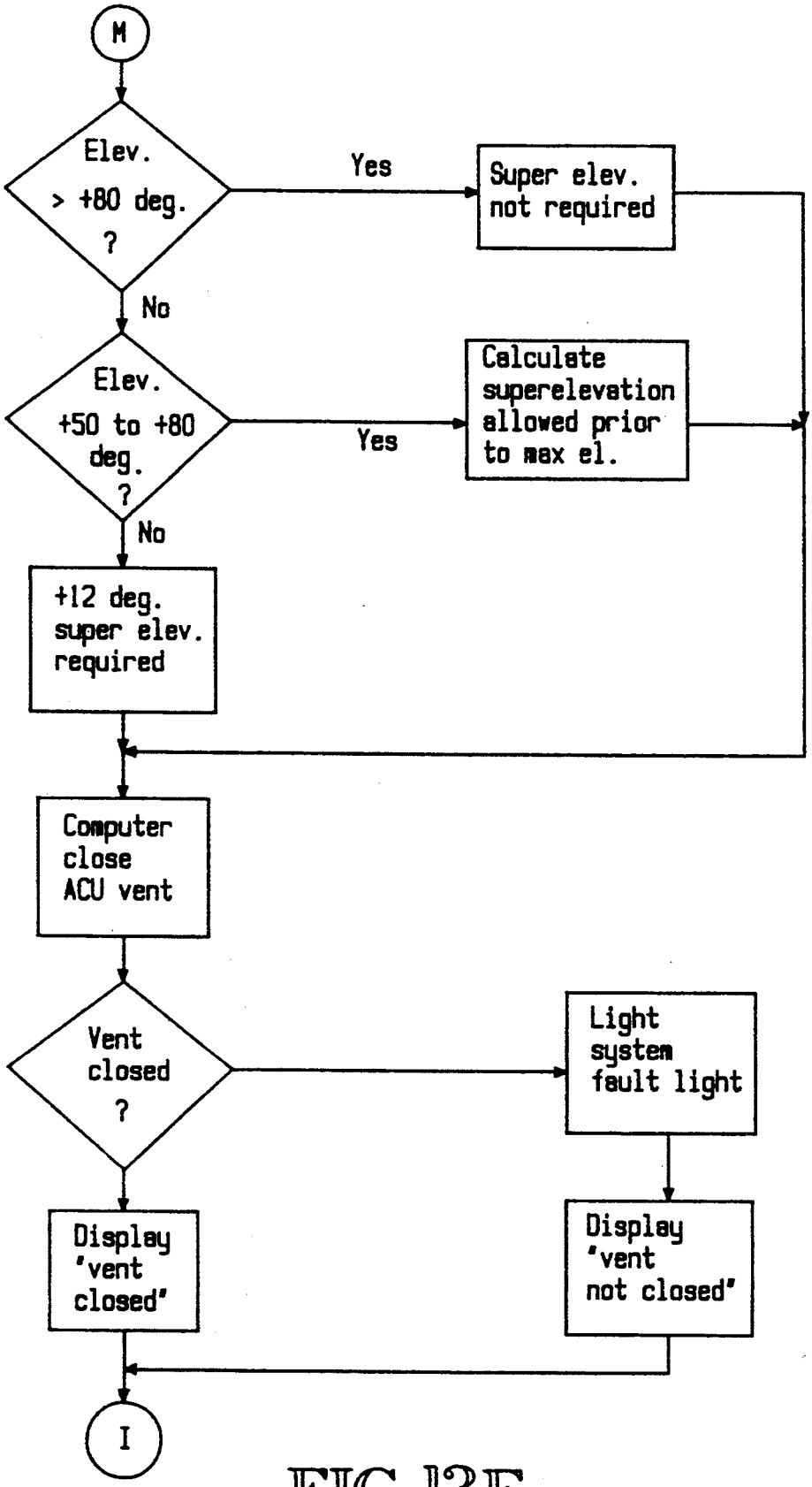
Figure 13F:
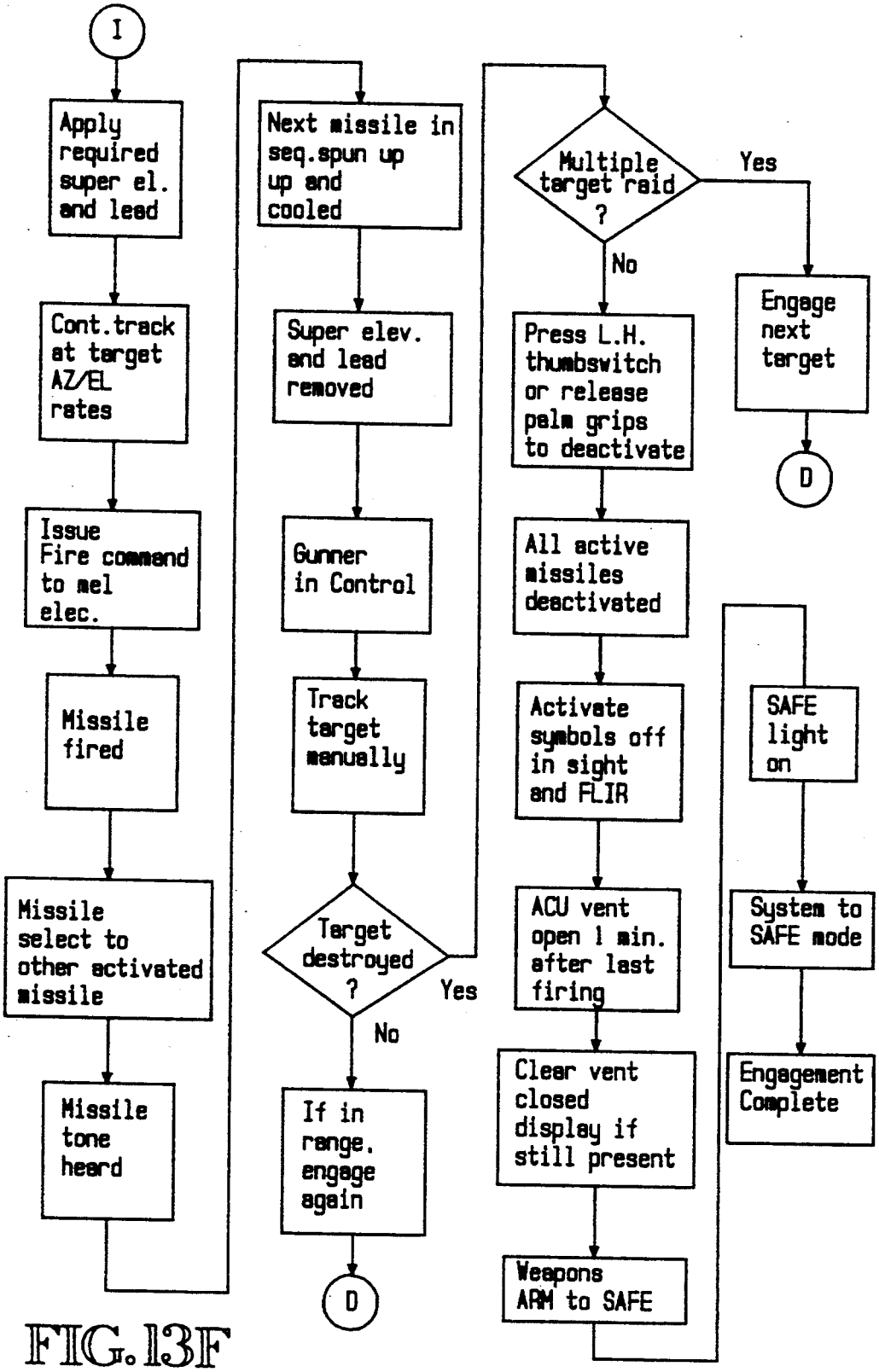

The control electronics 26 is shown in FIG. 12 with its inputs and outputs and the internal signal conditioning and processing functions illustrated. The signals from the hand controller 46 and from the FLIR and missile target seeker are conditioned by a signal conditioner 120 and multiplexed in a analog multiplexer 122. They are converted to digital signals in a A/D converter 124. The control signals from the CPU 126 responsive to the signal inputs are delivered through an A/D converter to the turret azimuth and elevation drive circuits 24, the control panel controls and to the missile control electronics. The CPU 126 uses plug-in cards and can readily be reprogrammed to accommodate changes in munitions such as the aforementioned machine gun and also updated or other missile munitions.

The operation of the invention will now be outlined by reference to the logic flow diagram in FIG. 13.

In the normal defensive situation, the gunner will be cued as to direction of the attacking aircraft. The cueing is normally done by a ground or airborne based radar installation, but can also be done by a central command and control installation or by radio warning by other friendly units in the area. If the gunner has not already activiated the missile, he will do so at that time and switch the systems switch to the engage mode. He sqeezes the palm grips on the hand controller 46 and slews the turret to face the anticipated approach direction of the attacking aircraft. The transparent canopy 13 of the cabin has a forwardly and upwardly facing view so the gunner can visually scan a sector of the sky wide enough to see all approaching aircraft from the direction from which the aircraft will appear.

The console will display the missile status so that the gunner will be able to confirm that a missile gyro is spun up and cooled and is ready to be fired. Also, the gunner will have ensured that the FLIR is cooled and is operational, especially if the attack is at night, so that he will have the infrared target acquisition capabilities.

When the target comes into view, the gunner is ready for him and has the advantage of preparation. He has the target in his sights and will have locked on long before the target even knows that the LADS is there. This is especially true in a static situation when the LADS can be camouflage since it is small, passive as to its sensors, and ready for the target. The attacking aircraft, on the other hand, is fast, but is easily seen and is expected.

The FLIR will be in its wide field of view and the laser range finder will be off so that no tell-tale light beam is produced by the LADS. When the target comes over the horizon, normally at a low angle and a high rate of speed, it will be acquired immediately on the FLIR and also will be sighted visually by the gunner looking through the transparent canopy. The gunner slews the cabin to line up the azimuth with the approaching target direction, and raises the munitions arms to center the target on the FLIR. He kicks the button which switches the FLIR to the narrow field of view and continues tracking the target manually by use of the hand controller 46. He pushes the IFF button and the target is immediately identified as unfriendly. The target can further be identified by way of a radio frequency interferometer to positively identify the target as unfriendly.

The laser range finder is now turned on and the control electronics has information as to range, azimuth, elevation, and rate of change of range, azimuth and elevation so that the trajectory of the target is known. If the gunner has not already done so, he now switches the safe/arm switch to arm and pushes the helicopter button if the target is a helicopter. The bore sight correction is applied by the comparison of the two sensor/-seekers or by a predetermined bore sight correction, whichever is appropriate. A symbol is projected on the sight glass to confirm for the gunner that a missile has been selected and activated and is ready to fire. In addition, for purposes of training or for defensive situations where a gunner has sector responsibility, a symbol will also be projected on the sight glass indicating that the turret is aimed in a direction in which fire permission has been preauthorized. In a training situation the symbol will indicate that the range safety officer has authorized missile firing.

When the missile gyro is spun up, the missile electronics produces a tone, indicating to the gunner that the missile sensor/seeker has centered on a hot IR source. The auditory tone varies according to the relative position of the sensor/seeker relative to the center of the IR source. This provides another confirmation to the gunner that the missile sensor/seeker is aimed at a target which it can track. When the gunner has maximized the tone, that is when he has centered the missile sensor/-seeker on the target, he squeezes the hand grip to uncage the missile seeker. The uncaged missile seeker then centers itself on the IR source and the missile electronics produces a tone in the gunner's earphone which verifies that the missile is uncaged. In addition, a symbol is projected on the sight glass which verifies to the gunner visually that the missile is uncaged.

The reticle projected on the transparent sight glass indicates any divergence between the aiming point of the missile seeker/sensor and the aiming position of the sight glass. In this way the gunner can verify that the target which he has acquired visually is the same target which the missile sensor/seeker is locked on.

If the reticle and the target image does not remain centered on the sight glass, the gunner will know immediately that missile sensor seeker is locked on the wrong target and he releases the "uncage" button to recage the seeker sensor and thereby center it again on the same target that the gunner is tracking.

When the gunner has verified that the missile sensor/-seeker is locked on the same target that he is tracking, he pushes the auto track select button. At this point, the control electronics begins utilizing the error signal produced by the missile sensor/seeker or the FLIR sensor/seeker to cause the elevation and azimuth error signals from the chosen sensor/seeker to be used by the azimuth and elevation control means to automatically track the target. The gunner is now free to concentrate on command, control, communications, and timing functions, that is, those functions which require human judgment, and he is free from the mechanical functions of target acquisition and tracking.

The laser range finder will inform the gunner whether the target is within missile range, and, if so, the gunner can launch the missile or he can wait for the target to approach closer to improve the chances of the kill. There may be circumstances in which the gunner elects to let one aircraft pass by unmolested so as not to alert the enemy that the area is defended. Then, when a large attacking force appears, they can all be destroyed before they have organized a coherent attack.

If the gunner elects to fire his missile, he pulls the fire trigger and initiates the automatic fire sequence. The computer samples and stores the azimuth and elevation rates at which the cabin and arms are changing position. The hand controller azimuth and elevation signals are disabled and the computer continues the azimuth and elevation rate of changes at the same rate that the turret was executing when the fire button was pushed. The optimum azimuth and elevation lead angles are calculated for the type of target, whether helicopter or fixed wing aircraft, and depending on the direction, the speed and the elevation of the target, and the optimal lead angles are inserted by providing an impulse to the elevation and azimuth control system 24 which indexes the turret to produce the correct lead angle. The air conditioner vent is closed and the fire command is issued to the missile electronics. Meanwhile, the turret continues to track at the same rate of elevation and azimuth that existed when the fire command was pushed. The missile electronics initiates the battery heating sequence and the electrical umbilical unplug actions. When the battery is producing a voltage at the required level, the missile booster is fired to eject the missile from the launch tube. The next missile in sequence is activated and ready to fire virtually instantly.

The ejected missile, after it clears the launch tube, fires its rocket motor and is guided by its sensor/seeker toward the target. Immediately after it is launched, the computer causes the elevation and azimuth of the missile pods to return to the predetermined tracking trajectory so that the gunner can fire the next missile in case the first missile misses the target. The gunner confirms visually that the missile has destroyed the target and simultaneously prepares himself to slew the cabin to the next target. When he confirms that the first target is destroyed he immediately operates the hand controller to slew the cabin toward the next target and the sequence begins again.

After a short predetermined time period which has been predetermined to insure that the immediate vacinity is clear of missile exhaust fumes, the air conditioner vent reopens so that fresh air can be vented into the cabin. If no other targets are in sight and the gunner is not advised that he should prepare for other targets to enter his sector of responsibility, he releases the palm grips or pushes the "deactivate" button so that next missile which has been activated can be deactivated and therefore preserve coolant.

The invention disclosed herein is small, lightweight and easily transported by many existing military air transports. It can be mounted on a variety of existing military carriers for a highly mobile and readily concealed air defense system. It is the first effective missile based air defense system which can be fired while the carrier is on the move and therefore provides the first mobile air defense missile based system for protecting convoys, attacking military formations and other mobile military assets. It utilizes to a larger extent predeveloped military hardware and weapon subsystems such as the Stinger missile, so its reliability is virtually preascertained and the development cost is low. The entire system is extremely inexpensive and of diminutive size and weight for an air defense system of its effectiveness. It is an uncomplicated system and very easy to learn, and the training of gunners has been proven to be fast and sure. It is an ideal air defense system for United States forces because it may be procured in large numbers and provide redundance and overlapping sectors of responsibility in air defense systems around many military assets because of its low cost and ease of training the gunners to operate. It is also ideally suited for many allied military forces because of its low cost and suitability for local manufacturing of many of its components.

Obviously, numerous modifications and variations of the disclosed embodiment will occur to those skilled in the art in view of this disclosure. Accordingly, it is expressly to be understood that these modifications and variations, and the equivalents thereof, may be practiced while remaining within the spirit and scope of the invention, as defined in the following claims.

We claim:

1. A heads-up sighting arrangement for a light air defense system having a turret including a cabin rotatably mounted on a base, an azimuth drive and azimuth control system for controlling a direction and speed of rotation of said cabin, a transparent canopy on said cabin and a height-adjustable seat within said cabin facing said transparent canopy for seating a gunner in a position to view airborne targets through said transparent canopy, and a munitions arm for mounting anti-aircraft munitions, said munitions arm being pivotally connected to the cabin for rotation therewith and for pivoting relative thereto about a horizontal axis so as to change an inclination of said munitions arm, a munitions arm elevation drive and elevation control system for controlling a direction and speed of pivoting of the munitions arm, such that the munitions arm may be aimed at and follow airborne targets by rotating the cabin and pivoting the munitions arm, said sight comprising:

a sight arm pivotally mounted on a pivot point inside said cabin for rotation therewith and for pivoting about a horizontal axis within said cabin relative thereto, said sight arm being linked to said munitions arm for synchronous motion therewith under control of said gunner by use of said azimuth and elevation control systems;

a transparent sight glass mounted on said sight arm between said height-adjustable seat and said transparent canopy in such a position that said gunner, sitting on said height-adjustable seat which has been adjusted to position a swivel axis of the gunner's neck in line with a swivel axis of said sight arm, looking straight ahead through said transparent sight glass, will be looking in the same direction as said munitions arm is pointed, regardless of an angle of said munitions arm from the horizontal axis;

an electro-optic sensor linked to said munitions arm to point in the same direction thereof, said electro-optic sensor producing signals indicative of targets within an angular and distance range of said electro-optic sensor; and projection means for receiving said signals and for producing and projecting indicia of the target sensed by said electro-optic sensor on said transparent sight glass in a position thereon indicative of a position of said sensed target relative to an aimed direction of said transparent sight glass, to enable the gunner to ensure that the electro-optic sensor is trained on the same target which he is viewing optically through said transparent sight glass.

2. The sight defined in claim 1, wherein said electro-optic sensor is an infrared sensor.

3. The sight defined in claim 1, wherein said sight arm is hinged intermediate said transparent sight glass and said pivot point such that said sight arm may be folded to provide room for the gunner to freely enter and exit from said cabin.

4. The sight defined in claim 1, wherein said electro-optic sensor locks onto and tracks targets within its angular and distance range independently of the aiming direction of said munitions arm.

5. The sight defined in claim 4 wherein said electro-optic sensor signals are error signals indicative of the elevation and azimuth deviation of the target on which it is locked from the direction in which said munitions arm is pointed, and further comprising means for utilizing said error signals in said azimuth and elevation control systems to drive said cabin and said munitions arm to track said target automatically.

6. A sight for a light air defense system having a turret including a cabin rotatably mounted on a base, an azimuth drive and azimuth control system for controlling a direction and speed of rotation of said cabin, a transparent canopy on said cabin and a height-adjustable seat within said cabin facing said transparent canopy for seating a gunner in a position to view airborne targets through said transparent canopy, and a munitions arm for mounting anti-aircraft munitions, said munitions arm being pivotally connected to the cabin for rotation therewith and for pivoting relative thereto about a horizontal axis so as to change an inclination of said munitions arm, a munitions arm elevation drive and elevation control system for controlling a direction and speed of pivoting of the munitions arm, such that the munitions arm may be aimed at and follow airborne targets by rotating the cabin and pivoting the munitions arm, said sight comprising:

a sight arm pivotally mounted on a pivot point inside said cabin for rotation therewith and for pivoting about a horizontal axis within said cabin relative thereto, said sight arm being linked to said munitions arm for synchronous motion therewith;

a transparent sight glass mounted on said sight arm between said height-adjustable seat and said transparent canopy in such a position that said gunner, sitting on said height-adjustable seat which has been adjusted to position a swivel axis of the gunner's neck in line with a swivel axis of said sight arm, looking straight ahead through said transparent sight glass, will be looking in the same direction as said munitions arm is pointed, regardless of an angle of said munitions arm from the horizontal axis;

an electro-optic sensor incorporated in said anti-aircraft munitions and linked to said munitions arm to point in the same direction thereof, said electro-optic sensor producing signals indicative of targets within an angular and distance range of said electro-optic sensor; and projection means for receiving said signals and for producing and projecting indicia of the target sensed by said electro-optic sensor on said transparent sight glass in a position thereon indicative of a position of said sensed target relative to an aimed direction of said transparent sight glass, to enable the gunner to ensure that the electro-optic sensor is trained on the same target which he is viewing optically through said transparent sight glass.

7. A sight for a light air defense system having a turret including a cabin rotatably mounted on a base, an azimuth drive and azimuth control system for controlling a direction and speed of rotation of said cabin, a transparent canopy on said cabin and a height-adjustable seat within said cabin facing said transparent canopy for seating a gunner in a position to view airborne targets through said transparent canopy, and a munitions arm for mounting anti-aircraft munitions, including guided missiles having aerodynamic control surfaces for controlling an orientation of said guided missile, said munitions arm being pivotally connected to the cabin for rotation therewith and for pivoting relative thereto about a horizontal axis so as to change an inclination of said munitions arm, a munitions arm elevation drive and elevation control system for controlling a direction and speed of pivoting of the munitions arm, such that the munitions arm may be aimed at and follow airborne targets by rotating the cabin and pivoting the munitions arm, said sight comprising:

a sight arm pivotally mounted on a pivot point inside said cabin for rotation therewith and for pivoting about a horizontal axis within said cabin relative thereto, said sight arm being linked to said munitions arm for synchronous motion therewith;

a transparent sight glass mounted on said sight arm between said height-adjustable seat and said transparent canopy in such a position that said gunner, sitting on said height-adjustable seat which has been adjusted to position a swivel axis of the gunner's neck in line with a swivel axis of said sight arm, looking straight ahead through said transparent sight glass, will be looking in the same direction as said munitions arm is pointed, regardless of an angle of said munitions arm from the horizontal axis;

an electro-optic sensor incorporated in said guided missiles and linked to said munitions arm to point in the same direction thereof, said electro-optic sensor producing signals indicative of targets within an angular and distance range of said electro-optic sensor;

projection means for receiving said signals and for projecting indicia of the target sensed by said electro-optic sensor on said transparent sight glass in a position thereon indicative of a position of said sensed target relative to an aimed direction of said transparent sight glass, to enable the gunner to ensure that the electro-optic sensor is trained on the same target which he is viewing optically through said transparent sight glass;

wherein said electro-optic sensor locks onto and tracks targets within its angular and distance range, independently of the aiming direction of said munitions arm, and said electro-optic sensor signals are error signals indicatative of the elevation and azimuth deviation of the target on which it is locked from the direction in which said munitions arm is pointed, and further comprising means for utilizing said error signals in said azimuth and elevation control systems to drive said cabin and said munitions arm to track said target automatically, and said error signals also control said aerodynamic surfaces on said guided missile to guide said guided missile to said target.

8. A sight for a light air defense system having a turret including a cabin rotatably mounted on a base, an azimuth drive and azimuth control system for controlling a direction and speed of rotation of said cabin, a transparent canopy on said cabin and a height-adjustable seat within said cabin facing said transparent canopy for seating a gunner in a position to view airborne targets through said transparent canopy, and a munitions arm for mounting anti-aircraft munitions, said munitions arm being pivotally connected to the cabin for rotation therewith and for pivoting relative thereto about a horizontal axis so as to change an inclination of said munitions arm, a munitions arm elevation drive and elevation control system for controlling a direction and speed of pivoting of the munitions arm, such that the munitions arm may be aimed and follow airborne targets by rotating the cabin and pivoting the munitions arm, said sight comprising:

a sight arm pivotally mounted on a pivot point inside said cabin for rotation therewith and for pivoting about a horizontal axis within said cabin relative thereto, said sight arm being linked to said munitions arm for synchronous motion therewith;

a transparent sight glass mounted on said sight arm between said height-adjustable seat and said transparent canopy in such a position that said gunner, sitting on said height-adjustable seat which has been adjusted to position a swivel axis of the gunner's neck in line with a swivel axis of said sight arm, looking straight ahead through said transparent sight glass, will be looking in the same direction as said munitions arm is pointed, regardless of an angle of said munitions arm from the horizontal axis;

an electro-optic sensor linked to said munitions arm to point in the same direction thereof, said electro-optic sensor producing signals indicative of targets within an angular and distance range of said electro-optic sensor;

projection means for receiving said signals and for projecting indicia of the target sensed by said electro-optic sensor on said siransparent sight glass in a position thereon indicative of a position of said sensed target relative to an aimed direction of said transparent sight glass, to enable the gunner to ensure that the electro-optic sensor is trained on the same target which he is viewing optically through said transparent sight glass;

wherein said error signals are conducted to said projection means and utilized thereby to produce said indicia on said transparent sight glass; and wherein said electro-optic sensor locks onto and tracks targets within its angular and distance range, independently of the aiming direction of said munitions arm, and said electro-optic sensor signals are error signals indicatative of the elevation and azimuth deviation of the target on which it is locked from the direction in which said munitions arm is pointed, and further comprising means for utilizing said error signals in said azimuth and elevation control systems to drive said cabin and said munitions arm to track said target automatically.

* * * * *